US009523940B2

(12) United States Patent
Hosokawa et al.

(10) Patent No.: US 9,523,940 B2
(45) Date of Patent: Dec. 20, 2016

(54) POWDER DETECTOR, DEVELOPING DEVICE, PROCESS CARTRIDGE, IMAGE FORMING APPARATUS, AND POWDER DETECTING METHOD

(71) Applicants: Hiroshi Hosokawa, Kanagawa (JP); Tetsuro Hirota, Kanagawa (JP); Kenji Kikuchi, Kanagawa (JP)

(72) Inventors: Hiroshi Hosokawa, Kanagawa (JP); Tetsuro Hirota, Kanagawa (JP); Kenji Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/958,090

(22) Filed: Dec. 3, 2015

(65) Prior Publication Data

US 2016/0170328 A1 Jun. 16, 2016

(30) Foreign Application Priority Data

Dec. 15, 2014 (JP) ..... 2014-253339
Mar. 13, 2015 (JP) ..... 2015-051265
May 22, 2015 (JP) ..... 2015-104330

(51) Int. Cl.
*G03G 15/08* (2006.01)

(52) U.S. Cl.
CPC ..... *G03G 15/0831* (2013.01); *G03G 15/0858* (2013.01); *G03G 15/086* (2013.01)

(58) Field of Classification Search
USPC ..... 399/9, 24, 25, 27–30, 107, 110, 111, 119,399/120
See application file for complete search history.

(56) References Cited

U.S. PATENT DOCUMENTS 4,314,242 A * 2/1982 Kuru ..... G03G 15/086 310/321
5,930,561 A 7/1999 Hosokawa et al.
6,163,666 A 12/2000 Hosokawa et al.
6,212,343 B1 4/2001 Hosokawa et al.
7,499,656 B2 * 3/2009 Kimura ..... G03G 15/0853 399/27
7,697,858 B2 * 4/2010 Moon ..... G03G 15/0862 399/261
2006/0018680 A1 1/2006 Hosokawa et al.
2010/0003055 A1 1/2010 Kikuchi et al.
(Continued)

FOREIGN PATENT DOCUMENTS

JP 62-104249 U 7/1987
JP 63-164767 U 10/1988
(Continued)

OTHER PUBLICATIONS

U.S. Appl. No. 14/884,961, filed Oct. 16, 2015.

*Primary Examiner* — Hoan Tran
(74) *Attorney, Agent, or Firm* — Oblon, McClelland, Maier & Neustadt, L.L.P.

(57) ABSTRACT

A powder detector to detect an amount of powder in the powder container includes a wall without a through hole, a vibration plate attached to an inner face of the wall, a contact member to vibrate the vibration plate, and a vibration detector to detect a vibration state of the vibration plate. The vibration detector is attached to an outer face of the wall to face the vibration plate via the wall. The powder has flowability, and the vibration state of the vibration plate is affected by the powder in the powder container.

16 Claims, 25 Drawing Sheets

(56) References Cited

U.S. PATENT DOCUMENTS

| | | | |
|---|---|---|---|
| 2014/0270818 | A1 | 9/2014 | Tanaka et al. |
| 2014/0312886 | A1 | 10/2014 | Hirota et al. |
| 2015/0268028 | A1 | 9/2015 | Hirota et al. |

FOREIGN PATENT DOCUMENTS

| | | |
|---|---|---|
| JP | 9-190066 | 7/1997 |
| JP | 2013-037280 | 2/2013 |

* cited by examiner

| n | 0 | 1 | 2 | 3 | 4 | 5 | 6 | 7 | 8 | 9 | 10 | 11 | |
|---|---|---|---|---|---|---|---|---|---|---|---|---|---|
| $S_n$ | 3400 | 3390 | 3360 | 3340 | 3310 | 3300 | 3310 | 3320 | 3350 | 3370 | 3380 | 3370 | ··· |
| $S_{n-1} - S_n$ | − | + | + | + | + | + | − | − | − | − | − | + | |

POWDER DETECTOR, DEVELOPING DEVICE, PROCESS CARTRIDGE, IMAGE FORMING APPARATUS, AND POWDER DETECTING METHOD

CROSS-REFERENCE TO RELATED APPLICATIONS

This patent application is based on and claims priority pursuant to 35 U.S.C. §119(a) to Japanese Patent Application Nos. 2014-253339 filed on Dec. 15, 2014, 2015-051265 filed on Mar. 13, 2015, and 2015-104330 filed on May 22, 2015 in the Japan Patent Office, the entire disclosure of each of which is hereby incorporated by reference herein.

BACKGROUND

Technical Field

Embodiments of the present invention relate to a powder detector, a developing device, a process cartridge, an image forming apparatus, and a powder detecting method.

Description of the Related Art

At present, use of information in the form of electronic data is increasing. Accordingly, printers and facsimile machines to output electronic data and image processing apparatus, such as scanners, to convert information into electronic data are widely used. Among such image processing apparatuses, there are apparatuses that employ electrophotography. In electrophotographic image formation, an electrostatic latent image formed on an image bearer such as a photoconductor is developed and transferred onto a recording medium such as a sheet of paper.

Electrophotographic image forming apparatuses typically include a developing device to develop the electrostatic latent image, and developer is supplied from a developer container to the developing device. The image forming apparatus includes a detector to detect the amount of developer remaining in the developing device or the developer container.

SUMMARY

An embodiment of the present invention provides a powder detector to detect an amount of powder in the powder container. The powder detector includes a wall without a through hole, a vibration plate attached to an inner face of the wall, a contact member to vibrate the vibration plate, and a vibration detector to detect a vibration state of the vibration plate. The vibration detector is attached to an outer face of the wall and disposed to face the vibration plate via the wall. The powder has flowability, and the vibration state of the vibration plate is affected by the powder in the powder container.

In another embodiment, an image forming apparatus includes an image forming unit to form an image, the powder container; and the powder detector described above, to contain a powder used by the image forming unit to form the image.

Yet another embodiment provides a developing device removably mountable in an image forming apparatus that includes a frequency-related data output to output frequency-related data, a signal oscillator to output an oscillation signal corresponding to a state of a magnetic flux passing through a space opposed to the signal oscillator, and a detection result processor to acquire, in each predetermined sampling cycle, the frequency-related data from the frequency-related data output. The developing device includes a developer container to contain developer, a vibration plate made of a material to affect the magnetic flux, and a contact member to vibrate the vibration plate. The vibration plate is disposed in the developer container to face the signal oscillator via a wall of the powder container and to vibrate in a direction in which the vibration plate faces the signal oscillator when the developing device is mounted in the image forming apparatus. The frequency-related data relates to a frequency of the oscillation signal and changes corresponding to a vibration state of the vibration plate. The detection result processor detects the vibration state of the vibration plate based on a change in the frequency-related data and determines an amount of the developer in the developer container based on the vibration state detected.

In yet another embodiment provides a process cartridge that is removably installable in an image forming apparatus and includes an image bearer, a charging device, a cleaning device, and the developing device described above.

In yet another embodiment, an image forming apparatus includes the process cartridge described above.

Yet another embodiment provides a powder detecting method to detect an amount of powder stored in a powder container and having flowability. The powder detecting method includes vibrating a vibration plate attached to an inner face of a wall of the powder container without a through hole; detecting, with a vibration detector, a vibration state of the vibration plate; and determining the amount of the powder in the powder container according to the vibration state detected. The vibration state of the vibration plate is affected by the powder in the powder container.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
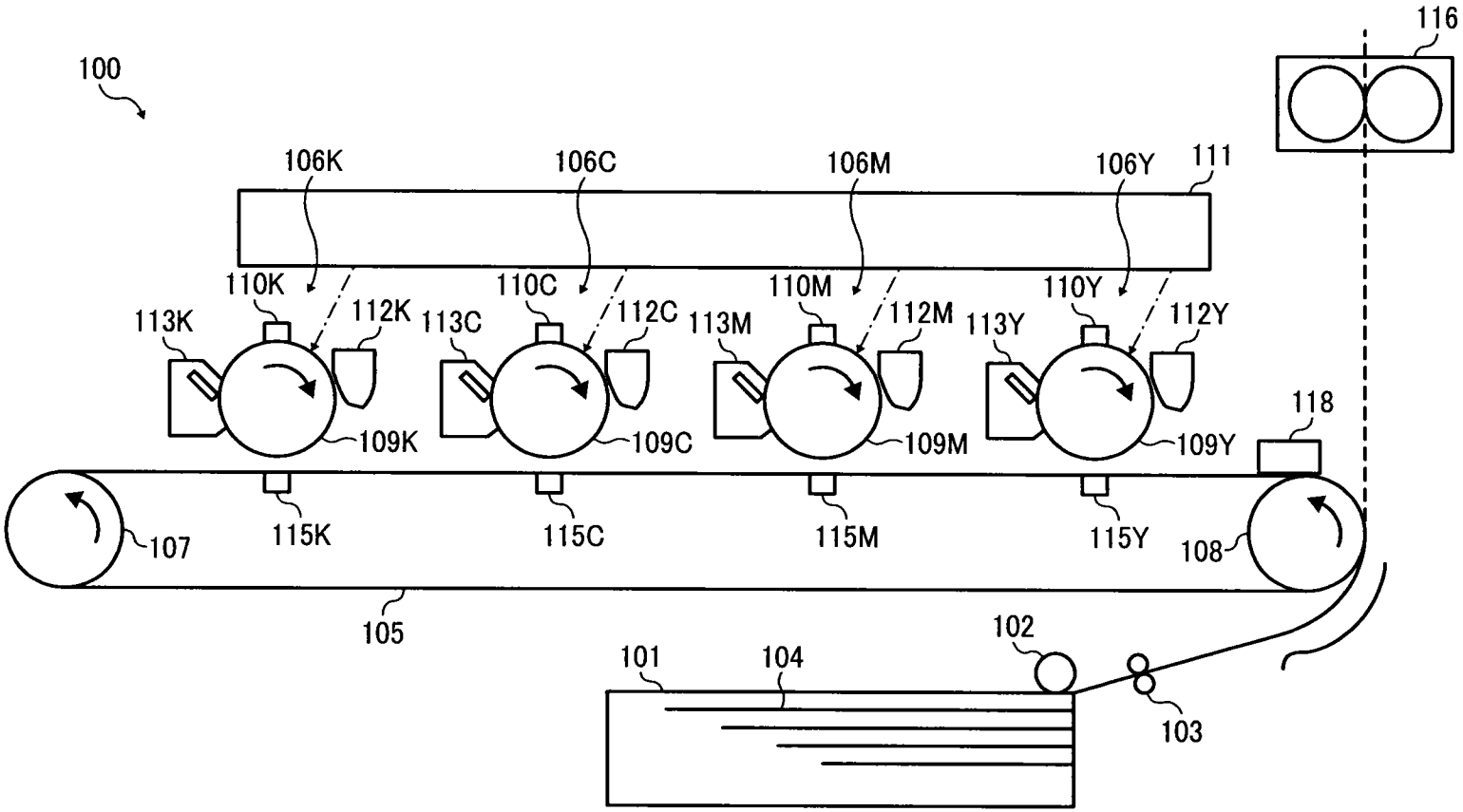
FIG. 1 illustrates a mechanical structure of an image forming apparatus common to first, second, and third embodiments.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Descriptions are given below of, as an embodiment of the present invention, detection of the amount of developer or toner remaining in an electrophotographic image forming apparatus, in particular, the amount of toner remaining in a sub-hopper to store toner in a portion between a developing device, which develops an electrostatic latent image on a photoconductor, and a container from which toner is supplied to the developing device.

Referring now to the drawings, wherein like reference numerals designate identical or corresponding parts throughout the several views thereof, and particularly to FIG. 1, a multicolor image forming apparatus according to an embodiment of the present invention is described.

First Embodiment

The image forming apparatus 100 illustrated in FIG. 1 is a so-called tandem-type image forming apparatus and includes multiple image forming units 106K, 106C, 106M, and 106Y for respective colors, arranged along an endless conveyor belt 105. Specifically, the image forming units 106Y, 106M, 106C, and 106K (hereinafter collectively "image forming units 106"), serving as electrophotographic process units, are arranged in that order from the upstream side in the direction in which the conveyor belt 105 transports the image. In the image forming apparatus 100, sheets 104 of recording media are fed from a sheet feeding tray 101 by a sheet feeding roller 102. The conveyor belt 105 is an intermediate transfer belt, and an intermediate transfer image to be transferred onto the sheet 104 is formed on the conveyor belt 105.

Additionally, a registration roller pair 103 stops the sheet 104 fed from the sheet feeding tray 101 and forwards the sheet 104 to a secondary transfer position where the image is transferred from the conveyor belt 105, timed to coincide with image formation in the image forming units 106.

The multiple image forming units 106 is similar in configuration except the color of toner images formed thereby. The image forming unit 106K forms black toner images, the image forming unit 106M forms magenta toner images, the image forming unit 106C forms cyan toner images, and the image forming unit 106Y forms yellow toner images. It is to be noted that the image forming unit 106Y is described in detail below as a representative since the image forming units 106Y, 106M, 106C, and 106K are similar in structure. Thus, descriptions of other image forming units 106M, 106C, and 106K, given subscripts "M", "C", and "K", instead of "Y" in the drawings, are omitted.

The conveyor belt 105 is an endless belt entrained around a driving roller 107 and a driven roller 108. A driving motor rotates the driving roller 107. The driving motor, the driving roller 107, and the driven roller 108 together constitute a driving unit to drive the conveyor belt 105.

Among the four image forming units 106, initially the image forming unit 106Y transfers toner images onto the conveyor belt 105. The image forming unit 106Y includes a photoconductor drum 109Y and components disposed around the photoconductor drum 109Y, namely, a charging device 110Y, an optical writing device 111, a developing device 112Y, a photoconductor cleaner 113Y, and a discharger. The optical writing device 111 directs light to the photoconductor drum 109Y, 109M, 109C, and 109K (collectively "photoconductor drums 109").

To form images, the charging device 110Y charges uniformly the outer circumferential face of the photoconductor drum 109Y in the dark, after which the optical writing device 111 directs light from a light source corresponding to yellow images to the photoconductor drum 109Y, thus forming an electrostatic latent image thereon. The developing device 112Y develops the electrostatic latent image into a visible image with yellow toner, thus forming a yellow toner image on the photoconductor drum 109Y.

The toner image is transferred by a transfer device 115Y onto the conveyor belt 105 at a primary transfer position where the photoconductor drum 109Y contacts or is closest to the conveyor belt 105. Thus, the yellow toner image is formed on the conveyor belt 105. Subsequently, the photoconductor cleaner 113Y removes toner remaining on the outer circumferential face of the photoconductor drum 109Y, and the discharger discharges the outer circumferential face of the photoconductor drum 109Y. Then, the photoconductor drum 109Y is on standby for subsequent image formation.

The yellow toner image formed on the conveyor belt 105 by the image forming unit 106Y is then transported to the image forming unit 106M as the conveyor belt 105 is rotated by the rollers. The image forming unit 106M performs image forming processes similar to those performed by the image forming unit 106Y, thereby forming a magenta toner image on the photoconductor drums 109M, and the magenta toner image is transferred and superimposed on the yellow toner image.

The yellow and magenta toner images on the conveyor belt 105 are further transported to the image forming units 106C and 106K, where cyan and black toner images are formed on the photoconductor drums 109C and 109K, respectively, and the cyan and black toner images are transferred on the superimposed toner image on the conveyor belt 105. Thus, a multicolor intermediate toner image is formed on the conveyor belt 105.

The sheets 104 contained in the sheet feeding tray 101 are sent out from the top sequentially. At a position where a conveyance path leading therefrom contacts or is closest to the conveyor belt 105, the intermediate toner image is transferred from the conveyor belt 105 onto the sheet 104. Thus, an image is formed on the sheet 104. The sheet 104 carrying the image is transported to a fixing device 116, where the image is fixed on the sheet 104. Then, the sheet 104 is ejected outside the image forming apparatus 100.

The conveyor belt 105 is provided with a belt cleaner 118. The belt cleaner 118 includes a cleaning blade pressed against the conveyor belt 105 to scrape off toner from the surface of the conveyor belt 105 at a position downstream from the secondary transfer position and upstream from the photoconductor drums 109 in the direction in which the conveyor belt 105 rotates (in the direction of rotation of the driving roller 107 and the driven roller 108) as illustrated in FIG. 1. Thus, the belt cleaner 118 serves as a developer remover.

Figure 2:
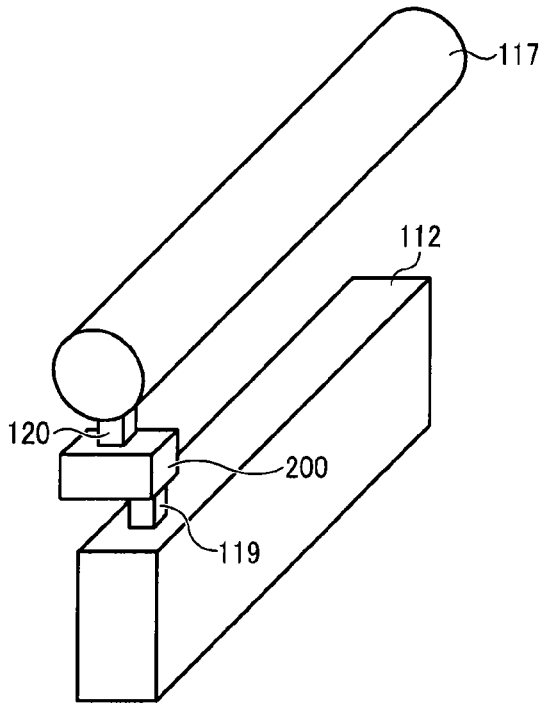
FIG. 2 is a perspective view illustrating a configuration for toner supply according to the first embodiment.

Referring to FIG. 2, descriptions are given below of structures for toner supply to the developing devices 112, which are similar among cyan (C), magenta (M), yellow (Y), and black (K) toners. Thus, FIG. 2 illustrates the structure to supply one of the four toners. In FIG. 2, a first toner supply passage 119 extends from a sub-hopper 200 to the developing device 112, and a second toner supply passage 120 extends from the toner bottle 117 to the sub-hopper 200. Toner contained in the toner bottle 117 is supplied through the second toner supply passage 120 to the sub-hopper 200.

The sub-hopper 200 temporarily stores toner supplied from the toner bottle 117 and supplies the toner to the developing device 112 according to the amount of toner remaining in the developing device 112. From the sub-hopper 200, toner is supplied through the first toner supply passage 119 to the developing device 112. When no or almost no toner remains in the toner bottle 117, toner is not supplied to the sub-hopper 200. An aspect of the present embodiment is to recognize that the amount of toner remaining in the sub-hopper 200 is small.

Figure 3:
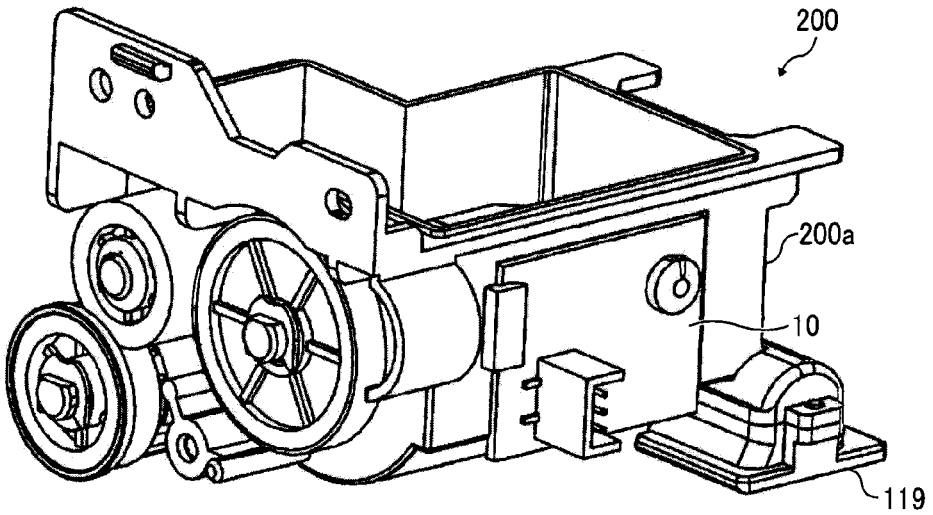
FIG. 3 is a perspective view illustrating an exterior of the sub-hopper according to the first embodiment.

FIG. 3 is a perspective view illustrating an exterior of the sub-hopper 200 according to the present embodiment.

As illustrated in FIG. 3, a magnetic flux sensor 10 is secured to an outer wall of a housing 200*a* of the sub-hopper 200. In FIG. 3, an upper side of the sub-hopper 200 is open, and a cover, which communicates with the second toner supply passage 120, is attached to the open side of the sub-hopper 200. Toner is discharged from the sub-hopper 200 through the first toner supply passage 119.

Figure 4:
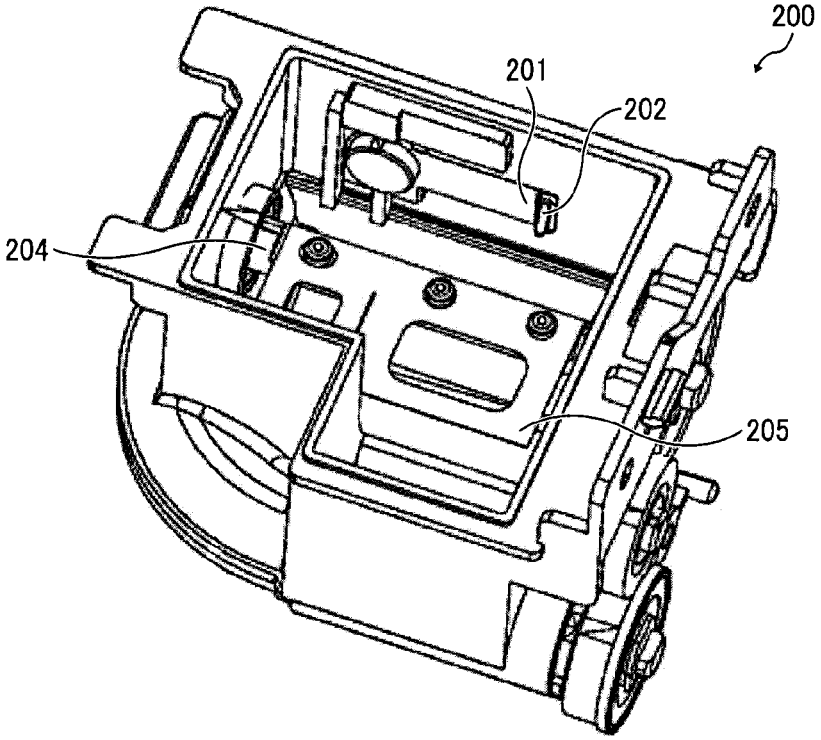
FIG. 4 is another perspective view illustrating the exterior of the sub-hopper illustrated in FIG. 3.

FIG. 4 is a perspective view illustrating an interior of the sub-hopper 200 according to the present embodiment. As illustrated in FIG. 4, a vibration plate 201 is secured to an inner face of the sub-hopper 200. Specifically, the vibration plate 201 is secured to the inner face of the housing 200*a* on the back of the outer face thereof to which the magnetic flux sensor 10 is secured. Accordingly, the vibration plate 201 is disposed facing the magnetic flux sensor 10.

The vibration plate 201 is planar and rectangle in the present embodiment. A first end of a long side of the vibration plate 201 is secured to the housing 200*a* of the sub-hopper 200, and a second end of the vibration plate 201 is not secured. Thus, the vibration plate 201 is cantilevered by the housing 200*a*. Additionally, a projection 202, serving as a weight as well as a contact portion, is disposed at the second end of the long side of the vibration plate 201.

The projection 202 is used for vibrating the vibration plate 201 and for adjusting the vibration frequency when the vibration plate 201 vibrates.

A shaft 204 and an agitator 205 are disposed inside the sub-hopper 200 to stir the toner contained therein. The shaft 204 rotates inside the sub-hopper 200. The agitator 205 is secured to the shaft 204. As the shaft 204 rotates, the agitator 205 stirs, by rotation, the toner contained inside the sub-hopper 200. A longitudinal direction of the vibration plate 201 is arranged substantially parallel to the axial direction of the shaft 204.

The agitator 205 has a capability to flip, by rotation, the projection 202 provided to the vibration plate 201 in addition to toner stirring capability. Each time the agitator 205 makes one rotation, the agitator 205 flips the projection 202, and the vibration plate 201 vibrates. In other words, the agitator 205 serves as a contact member to contact the vibration plate 201, and the vibration plate 201 vibrates due to the contact with the agitator 205. An aspect of the present embodiment is to detect the vibration of the vibration plate 201, thereby detecting the amount of toner remaining inside the sub-hopper 200.

Next, descriptions are given below of an internal structure of the magnetic flux sensor 10 according to the present embodiment with reference to FIG. 5.

Figure 5:
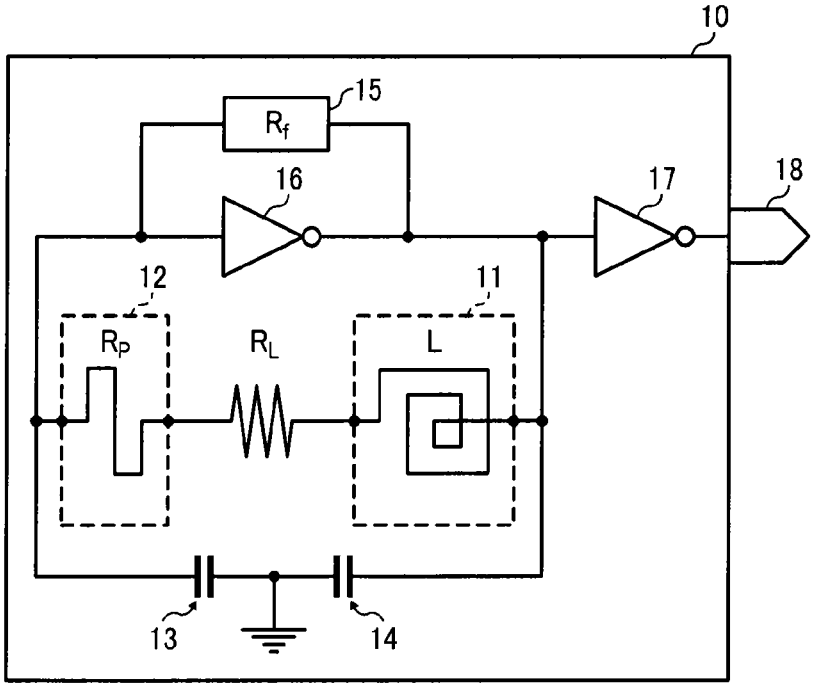
FIG. 5 illustrates circuitry of a magnetic flux sensor common to the first, second, and third embodiments.

As illustrated in FIG. 5, the magnetic flux sensor 10 is an oscillator circuit based on a Colpitts-type LC oscillator circuit and includes a coil pattern 11, a resistor pattern 12, first and second capacitors 13 and 14, a feedback resistor 15 having a resistance value $R_f$, unbuffered integrated circuits (ICs) 16 and 17, and an output terminal 18. It is to be noted that reference character "$R_L$" represents circuit resistance caused by conducting wire (signal wire) forming the circuit illustrated in FIG. 5.

The coil pattern 11 is a planar coil made from conducting wire (signal wire) printed on a board 300 (illustrated in FIG. 7) of the magnetic flux sensor 10. As illustrated in FIG. 5, the coil pattern 11 has an inductance L attained by the coil. In the coil pattern 11, the inductance L changes depending on the magnetic flux passing through a space opposing a board face on which the coil pattern 11 is printed. The magnetic flux sensor 10 in the present embodiment is used as a signal oscillator to output a signal having a frequency corresponding to the magnetic flux passing through the space opposed to the board face bearing the coil pattern 11.

Similar to the coil pattern 11, the resistor pattern 12 is a planar resistor made of a planar pattern of conducting wire printed on the board 300. The resistor pattern 12 in the present embodiment has a serpentine or zigzag pattern, thereby better inhibiting flow of electrical current compared with a resistor having a linear pattern. Incorporating the resistor pattern 12 is one aspect of the present embodiment. The term "zigzag" means the shape in which the wire is bent and folded back, like a serpentine, multiple times to reciprocate in a predetermined direction. Referring to FIG. 5, the resistor pattern 12 has a resistance value $R_p$. The coil pattern 11 and the resistor pattern 12 are connected in series with each other.

The first and second capacitors 13 and 14 serve as a capacitance and a part of the Colpitts-type LC oscillator circuit including the coil pattern 11. Accordingly, the first and second capacitors 13 and 14 are connected serially with the coil pattern 11 and the resistor pattern 12. A loop including the coil pattern 11, the resistor pattern 12, and the first and second capacitors 13 and 14 serves as a resonance current loop.

The feedback resistor 15 is inserted to stabilize a bias voltage. With a function of the unbuffered ICs 16 and 17, fluctuations in potential of a part of the resonance current loop are output as a rectangular wave corresponding to the resonance frequency from the output terminal 18.

With this configuration, the magnetic flux sensor 10 oscillates at a frequency f corresponding to the inductance L, the resistance value $R_P$, and a capacitance C of the first and second capacitors 13 and 14. The frequency f is expressed by Formula 1 below.

$$f = \frac{1}{2\pi}\sqrt{\frac{1}{LC} - \left(\frac{R_L + R_P}{2L}\right)^2} \qquad \text{Formula 1}$$

The inductance L changes depending on the presence and density of the magnetic material adjacent to the coil pattern 11 (planar coil). Thus, according to the oscillation frequency of the magnetic flux sensor 10, the magnetic permeability in the space adjacent to the coil pattern 11 can be determined.

It is to be noted that the circuit resistance $R_L$ (resistance value) is determined by the length of the conducting wire, and most of the conducting wire is used to form the coil pattern 11 in the magnetic flux sensor 10 according to the present embodiment. Accordingly, the circuit resistance $R_L$ is substantially identical to the resistance value attained by the conducting wire forming the coil pattern 11.

As described above, the magnetic flux sensor 10 faces the vibration plate 201 via the housing 200*a* of the sub-hopper 200 in the present embodiment. Accordingly, the magnetic flux generated by the coil pattern 11 passes through the vibration plate 201. That is, the vibration plate 201 affects the magnetic flux generated by the coil pattern 11 and further affects the inductance L. Consequently, the vibration plate 201 affects the frequency of signal of the magnetic flux sensor 10, which is an aspect of the present embodiment.

Figure 6:
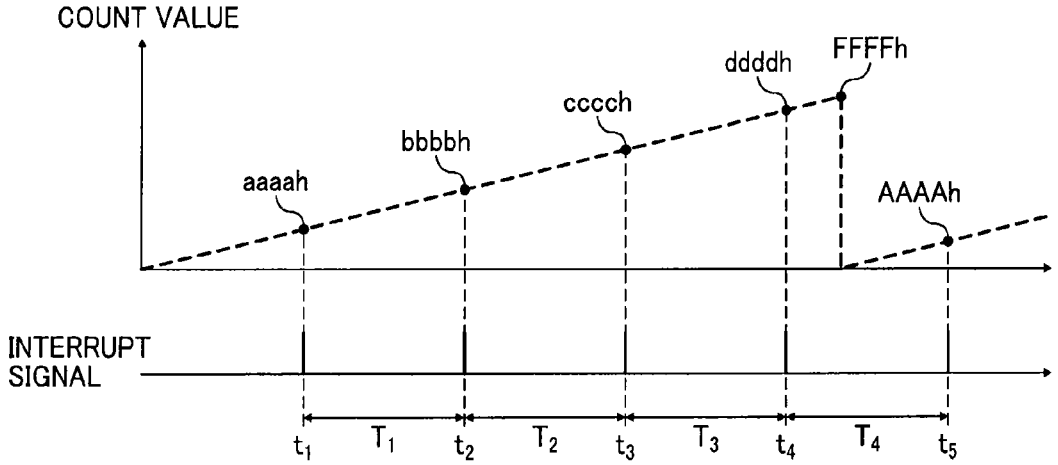
FIG. 6 is a chart of counting of signal output from the magnetic flux sensor illustrated in FIG. 5.

FIG. 6 is a chart of counting of signal output from the magnetic flux sensor 10 according to the present embodiment.

If the magnetic flux generated by the coil pattern 11 does not change, the magnetic flux sensor 10 keeps oscillating at a constant frequency basically. Consequently, the count value of the signal of the magnetic flux sensor 10 increases constantly with elapse of time as illustrated in FIG. 6, and, at Time points $t_1$, $t_2$, $t_3$, $t_4$, and $t_5$, count values aaaah, bbbbh, cccch, ddddh, and AAAAh are acquired respectively as illustrated in FIG. 6.

By calculating the count values at those timings based on Periods $T_1$, $T_2$, $T_3$, and $T_4$ in FIG. 6, respectively, the frequency in each of Periods $T_1$, $T_2$, $T_3$, and $T_4$ in FIG. 6 is calculated. For example, in a case where an interrupt signal is output each time a reference clock equivalent for 2 milliseconds (ms) is counted, the count value in each of Periods $T_1$, $T_2$, $T_3$, and $T_4$ illustrated in FIG. 6 is divided with 2 (ms), thereby calculating the frequency f (Hz) of the magnetic flux sensor 10 in that period.

Additionally, when the upper limit of the count value is FFFFh as illustrated in FIG. 6, the oscillation frequency f (Hz) in Period $T_4$, can be calculated by dividing, with 2 (ms), the sum of the AAAAh and a value obtained by deducting ddddh from FFFFh.

Thus, the image forming apparatus 100 according to the present embodiment acquires the frequency of signal generated by the magnetic flux sensor 10 and determines, based on the result of acquisition, a phenomenon corresponding to the oscillation frequency of the magnetic flux sensor 10. In the magnetic flux sensor 10 according to the present embodiment, the inductance L changes in response to the state of the vibration plate 201 disposed facing the coil pattern 11, and the frequency of signal output from the output terminal 18 changes accordingly.

Consequently, a controller 20 (illustrated in FIG. 8) to acquire the signal recognizes the state of the vibration plate 201 disposed facing the coil pattern 11. An aspect of the present embodiment is to detect the state of developer inside the sub-hopper 200 based on the state of the vibration plate 201.

It is to be noted that, although the frequency is obtained by dividing the count value of the signal by the period in the description above, alternatively, in a case where the period during which the count value is acquired is fixed, the acquired count value can be used as is as the parameter indicating the frequency.

Figure 7:
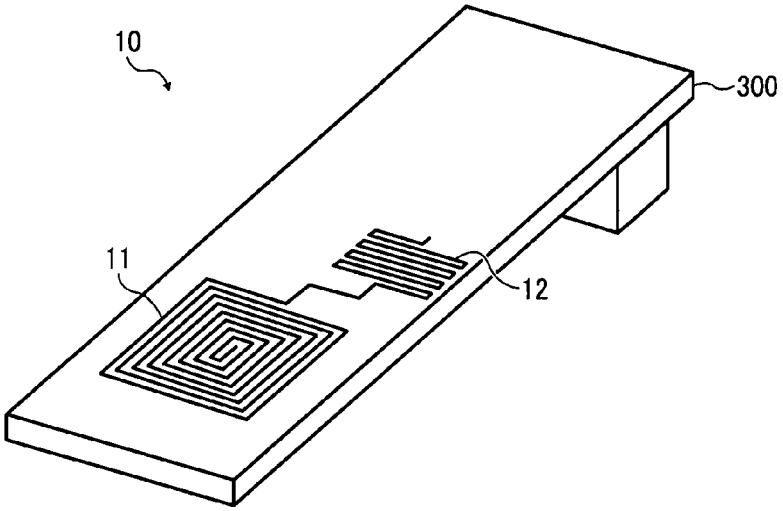
FIG. 7 is a perspective view illustrating an exterior of the magnetic flux sensor illustrated in FIG. 5.

FIG. 7 is a perspective view illustrating an exterior of the magnetic flux sensor 10 according to the present embodiment. In FIG. 7, the face of the board 300 on which the coil pattern 11 and the resistor pattern 12 are formed is faced up. That is, a detection face for detecting magnetic permeability, which is to oppose the space subjected to magnetic permeability detection, is faced up.

As illustrated in FIG. 7, the resistor pattern 12, which is connected serially to the coil pattern 11, is printed on the detection face on which the coil pattern 11 is printed. As described above with reference to FIG. 5, the coil pattern 11 is made of conducting wire (signal line) printed in a spiral shape on the board face. Additionally, the resistor pattern 12 is made of conducting wire printed in a serpentine or zigzag pattern on the board face, and the above-described function of the magnetic flux sensor 10 is established by these patterns.

The coil pattern 11 and the resistor pattern 12 serves as a detecting portion of the magnetic flux sensor 10 according to the present embodiment. The magnetic flux sensor 10 is attached to the sub-hopper 200 with the detecting portion facing the vibration plate 201.

Next, descriptions are given below of a structure to acquire outputs from the magnetic flux sensor 10 in the image forming apparatus 100 according to the present embodiment, with reference to FIG. 8.

Figure 8:
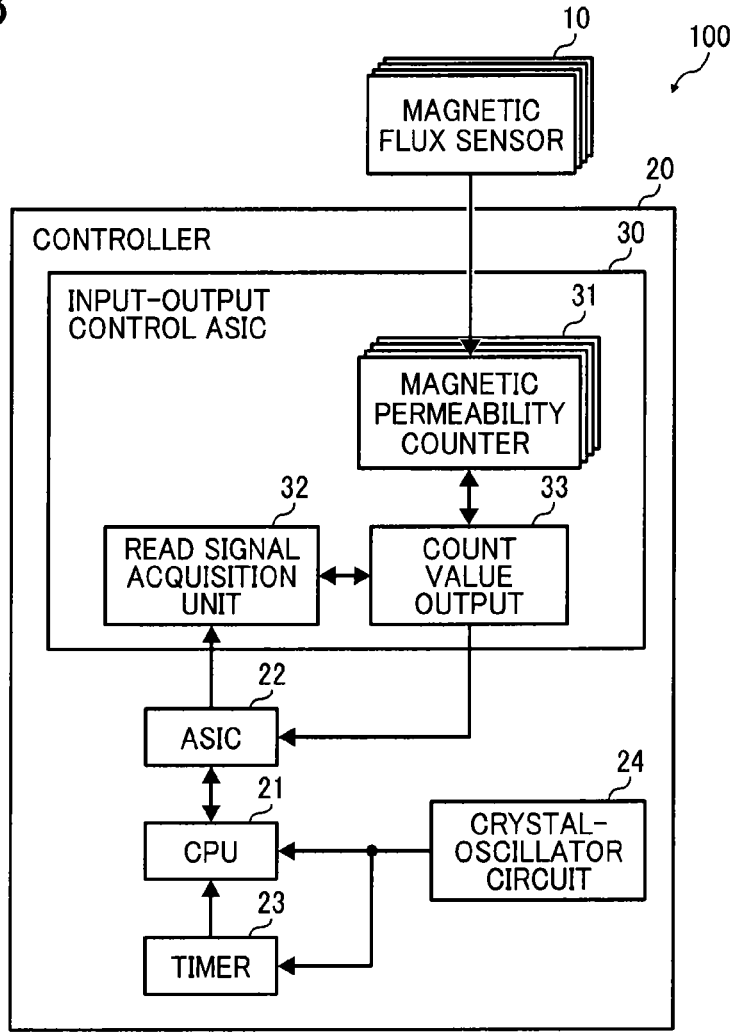
FIG. 8 is a block diagram illustrating a control configuration to acquire the signal output from the magnetic flux sensor illustrated in FIG. 5.

FIG. 8 is a schematic block diagram of the controller 20 to acquire the signal from the magnetic flux sensor 10. The controller 20 includes a central processing unit (CPU) 21, an application specific integrated circuit (ASIC) 22, a timer 23, a crystal-oscillator circuit 24, and an input-output control ASIC 30.

The CPU 21 is a computation unit and controls operation of the entire controller 20 by computation according to programs stored in a memory such as a read only memory (ROM). The ASIC 22 functions as a connection interface between a system bus, to which the CPU 21 and a random access memory (RAM) are connected, and another device.

The timer 23 outputs an interrupt signal to the CPU 21 each time the count of reference clock input from the crystal-oscillator circuit 24 reaches a predetermined count. In response to the interrupt signal input from the timer 23, the CPU 21 outputs the read signal for acquiring the output value of the magnetic flux sensor 10. The crystal-oscillator circuit 24 generates the reference clock to operate respective elements inside the controller 20.

The input-output control ASIC 30 acquires the signal output from the magnetic flux sensor 10 and converts the signals into data processable inside the controller 20. In the configuration illustrated in FIG. 8, the input-output control ASIC 30 includes a magnetic permeability counter 31, a read signal acquisition unit 32, and a count value output 33. As described above, the magnetic flux sensor 10 according to the present embodiment is an oscillator circuit that outputs a rectangular wave having the frequency corresponding to the magnetic permeability of the space as a detection target.

The magnetic permeability counter 31 increments the value according to the rectangular wave output from the magnetic flux sensor 10. That is, the magnetic permeability counter 31 serves as a target signal counter to count the number of the signal whose frequency is to be calculated. It is to be noted that, in the present embodiment, multiple magnetic flux sensors 10 are provided for the respective sub-hoppers 200 connected to developing devices 112Y, 112M, 112C, and 112K, and multiple magnetic permeability counters 31 are used accordingly.

The read signal acquisition unit 32 acquires, from the CPU 21 via the ASIC 22, the read signal, which is a command to acquire the count value of the magnetic permeability counter 31. Acquiring the read signal from the CPU 21, the read signal acquisition unit 32 inputs, to the count value output 33, a signal instructing output of the count value. According to the signal from the read signal acquisition unit 32, the count value output 33 outputs the count value of the magnetic permeability counter 31.

It is to be noted that the CPU 21 has an access to the input-output control ASIC 30, for example, via a register. Accordingly, the CPU 21 outputs the above-described read signal by writing a value in a predetermined register included in the input-output control ASIC 30. Additionally, the count value from the count value output 33 is stored in a predetermined register of the input-output control ASIC 30, from which the CPU 21 acquires the count value. The controller 20 illustrated in FIG. 8 is provided to an apparatus or a device other than the magnetic flux sensor 10 in one embodiment. In another embodiment, the controller 20 is mounted, as a circuit including the CPU 21, on the board 300 of the magnetic flux sensor 10.

In the above-described structure, the CPU 21 detects the vibration state of the vibration plate 201 based on the count value acquired from the count value output 33 and, based on the detection result, detects the amount of toner remaining in the sub-hopper 200. That is, a detection result processor is implemented by the CPU 21 performing computation according to a predetermined program. The count value acquired from the count value output 33 is used as frequency-related data indicating the frequency of the magnetic flux sensor 10, which changes corresponding to the vibration of the vibration plate 201.

Next, descriptions are given below of effects of the vibration plate 201 on the oscillation frequency of the magnetic flux sensor 10 according to the present embodiment.

Figure 9:
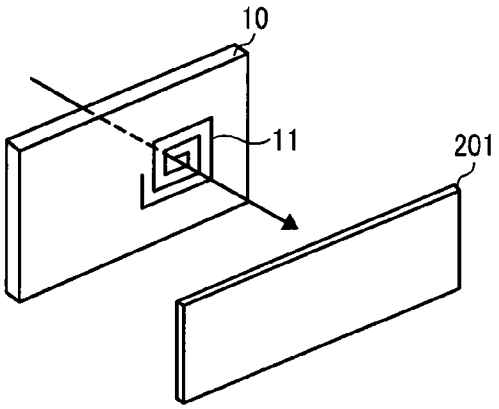
FIG. 9 illustrates a distance between the magnetic flux sensor and a vibration plate common to the first, second, and third embodiments.

Referring to FIG. 9, the board face of the magnetic flux sensor 10 bearing the coil pattern 11 faces the vibration plate 201 via the housing 200*a* of the sub-hopper 200 (illustrated in FIG. 3). Then, a magnetic flux arises, centering around a center of the coil pattern 11, and the magnetic flux penetrates the vibration plate 201.

Figure 10:
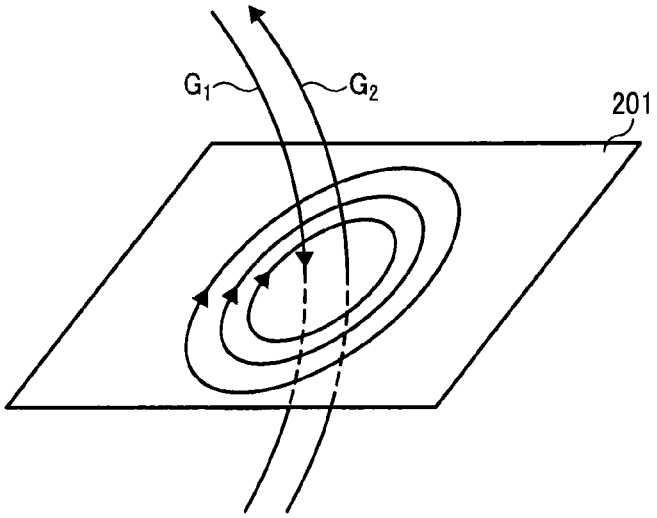
FIG. 10 illustrates actions of magnetic flux penetrating the vibration plate illustrated in FIG. 9.

For example, the vibration plate 201 is made of a plate of Steel Use Stainless (SUS) according to Japan Industrial Standard (JIS). As illustrated in FIG. 10, an eddy current is generated in the vibration plate 201 as a magnetic flux $G_1$ penetrates the vibration plate 201. A magnetic flux $G_2$ is generated by the eddy current and acts to cancel the magnetic flux $G_1$ generated by the coil pattern 11. As the magnetic flux $G_1$ is thus canceled, the inductance L in the magnetic flux sensor 10 decreases. As shown by Formula 1 above, the oscillation frequency f increases as the inductance L decreases.

The strength of the eddy current, which occurs inside the vibration plate 201 due to the magnetic flux generated by the coil pattern 11, changes according to the strength of the magnetic flux as well as a distance between the coil pattern 11 and the vibration plate 201.

Figure 11:
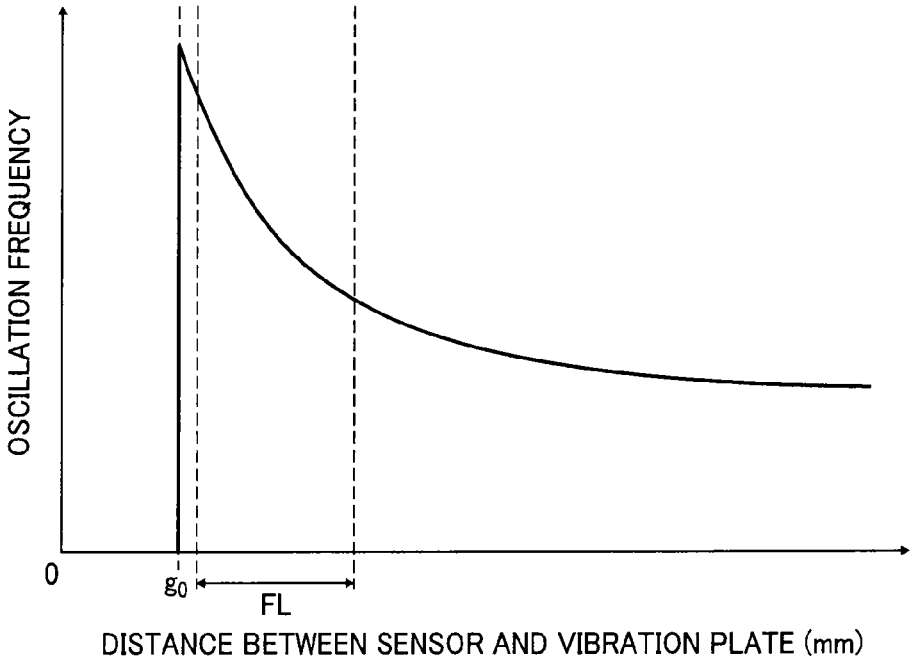
FIG. 11 is a graph of changes in oscillation frequency of the magnetic flux sensor corresponding to the distance between the magnetic flux sensor and the vibration plate, common to the first, second, and third embodiments.

FIG. 11 is a graph of oscillation frequency of the magnetic flux sensor 10 corresponding to the distance between the coil pattern 11 and the vibration plate 201.

The strength of the eddy current occurring inside the vibration plate 201 is inversely proportional to the distance between the coil pattern 11 and the vibration plate 201. Accordingly, as the distance between the coil pattern 11 and the vibration plate 201 decreases, the oscillation frequency of the magnetic flux sensor 10 becomes higher. When the distance is smaller than a threshold, the inductance L is too low, and the magnetic flux sensor 10 does not oscillate.

Therefore, the oscillation frequency is zero in a period till a time point $g_0$ in FIG. 11. By contrast, as the distance between the coil pattern 11 and the vibration plate 201 increases, the oscillation frequency of the magnetic flux sensor 10 converges to a frequency not affected by the eddy current occurring inside the vibration plate 201. The oscillation frequency changes steeply in a range FL in FIG. 11.

In the sub-hopper 200 according to the present embodiment, the CPU 21 detects the vibration of the vibration plate 201 by using characteristics illustrated in FIG. 11. The amount of toner remaining in the sub-hopper 200 is detected based on the vibration of the vibration plate 201 thus detected, which is an aspect of the present embodiment. In other words, the vibration plate 201 and the magnetic flux sensor 10 illustrated in FIG. 9 as well as the structure to process the signal output from the magnetic flux sensor 10 is used as a powder detector according to the present embodiment. The powder detector is used as a developer amount detector to detect the amount of developer (e.g., toner) remaining in the present embodiment. Additionally, the magnetic flux sensor 10 serves as a vibration detector (e.g., a signal oscillator).

The vibration of the vibration plate 201 flipped by the agitator 205 is expressed by an eigenfrequency defined by rigidity of the vibration plate 201 and weight of the projection 202, and an attenuation ratio defined by external factors to absorb the vibration energy. The external factors to absorb the vibration energy include, the presence of toner that contacts the vibration plate 201 in the sub-hopper 200, in addition to fixed factors such as the holding strength of the mount 201*a* cantilevering the vibration plate 201 and air resistance.

The amount or state of toner that contacts the vibration plate 201 changes depending on the amount of toner remaining in the sub-hopper 200. Accordingly, by detecting the vibration of the vibration plate 201, the amount of toner remaining in the sub-hopper 200 is detected. In the sub-hopper 200 according to the present embodiment, the agitator 205 to stir toner flips the vibration plate 201 and vibrates the vibration plate 201 periodically according to the rotation cycle.

Next, descriptions are given below of placement of components around the vibration plate 201 in the sub-hopper 200 and the structure for the agitator 205 to flip the vibration plate 201.

Figure 12:
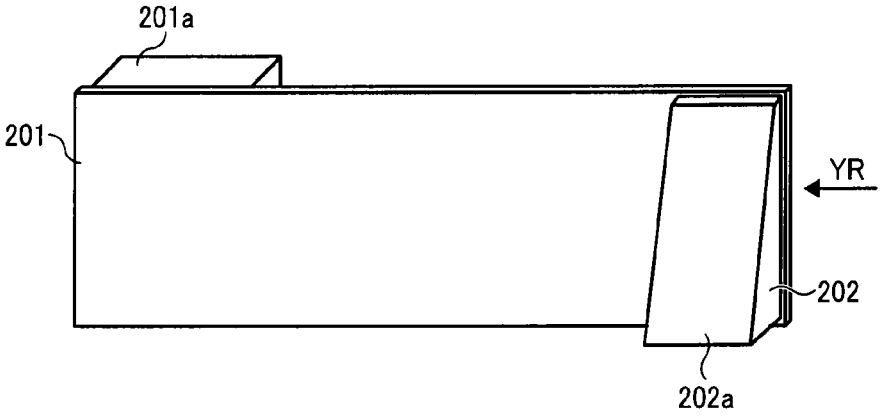
FIG. 12 is a perspective view illustrating placement of the vibration plate and adjacent components according to the first embodiment.

FIG. 12 is a perspective view illustrating a component layout around the vibration plate 201. As illustrated in FIG. 12, the vibration plate 201 is secured via a mount 201*a* to the housing 200*a* of the sub-hopper 200 (in FIG. 3). In FIG. 12, reference character 202*a* represents an inclined face of the projection 202.

Figure 13:
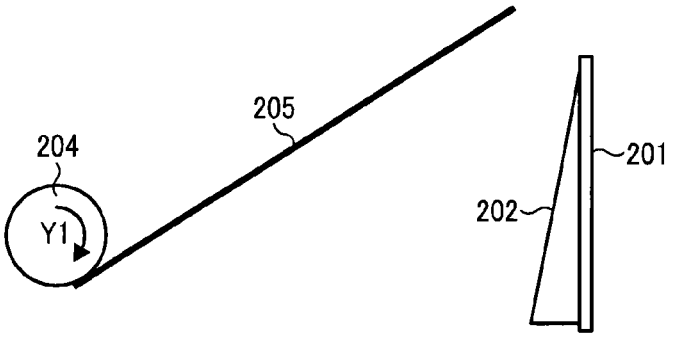
FIG. 13 is a side view illustrating relative positions of the vibration plate and an agitator according to the first embodiment.

FIG. 13 is a side view illustrating a rotation position of the shaft 204. When the shaft 204 is at the position illustrated in FIG. 13, the agitator 205 is about to contact the projection 202 attached to the vibration plate 201. The shaft 204 rotates so that the agitator 205 rotates clockwise in FIG. 13 as indicated by arrow Y1.

As illustrated in FIGS. 12 and 13, the projection 202 projects from a plate face (on the front side of paper on which FIG. 12 is drawn), not an end face, of the vibration plate 201 and inclined relative to the plate face of the vibration plate 201 when viewed in the direction indicated by arrow YR. Specifically, the projection 202 has the inclined face 202*a* that approaches the shaft 204 along the direction of rotation of the agitator 205. The inclined face 202*a* of the projection 202 is pushed by the agitator 205 when the agitator 205 flips the vibration plate 201 to vibrate the vibration plate 201.

Figure 14:
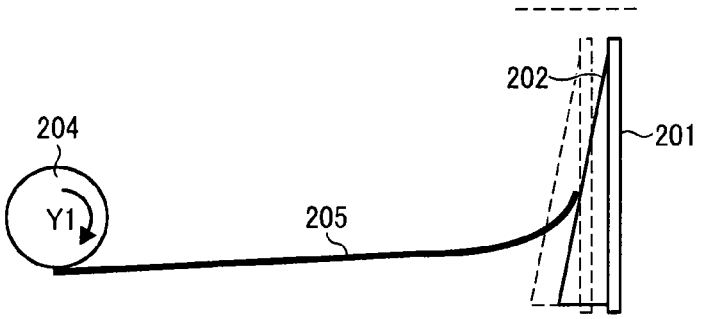
FIG. 14 is another side view illustrating the relative positions of the vibration plate and the agitator according to the first embodiment.

FIG. 14 is a side view of the agitator 205, in which the agitator 205 is positioned downstream in the direction indicated by arrow Y1 from the position illustrated in FIG. 13.

As the agitator 205 rotates further while keeping in contact with the projection 202, the vibration plate 201 is pushed and deformed along the inclined face 202*a* of the projection 202. In FIG. 14, broken lines represent positions of the vibration plate 201 and the projection 202 in a state in which no external force is applied thereto (hereinafter "stationary state"). As illustrated in FIG. 14, the vibration plate 201 and the projection 202 are pushed in by the agitator 205.

Figure 15:
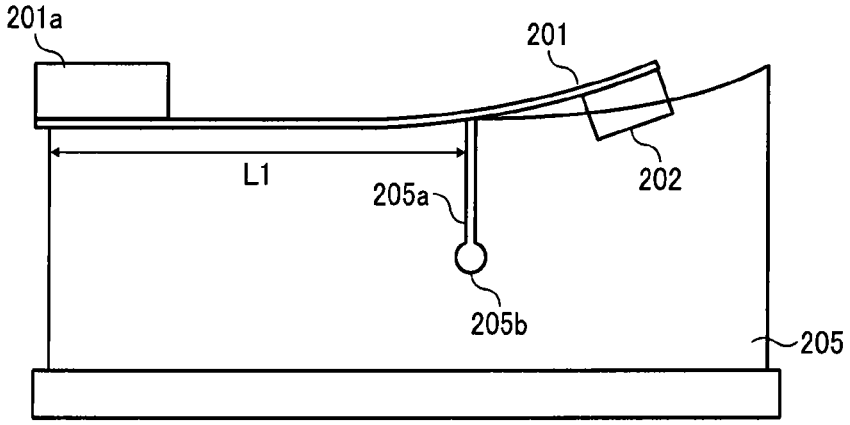
FIG. 15 is a top view illustrating the relative positions of the vibration plate and the agitator according to the first embodiment.

FIG. 15 is a top view of vibration plate 201 and the agitator 205 in the state illustrated in FIG. 14.

Since the vibration plate 201 is secured via the mount 201*a* to the housing 200*a*, the position of the first end of the vibration plate 201 on the side of the mount 201*a* does not change. By contrast, the opposite end of the vibration plate 201, in which the projection 202 is disposed, is pushed by the agitator 205 and moves to the side opposite the side on which the shaft 204 is positioned. Consequently, the vibration plate 201 deforms, starting from the mount 201*a*, as illustrated in FIG. 15. Energy to vibrate the vibration plate 201 is accumulated in the vibration plate 201 being in the deformed state.

It is to be noted that, in the configuration illustrated in FIG. 15, the agitator 205 includes a slit 205*a* positioned between a portion to contact the projection 202 (having a length L1 in FIG. 15) and the rest of the agitator 205. With this configuration, even if the agitator 205 receives strong force while pushing the projection 202, damage to the agitator 205 is inhibited.

The slit 205*a* includes a round end 205*b* at a start point of slit. When the amount of deformation differs between the portions adjoining via the slit 205*a*, the round end 205*b* disperses the stress given to the start point of the slit 205*a*, thereby inhibiting damage to the agitator 205.

Figure 16:
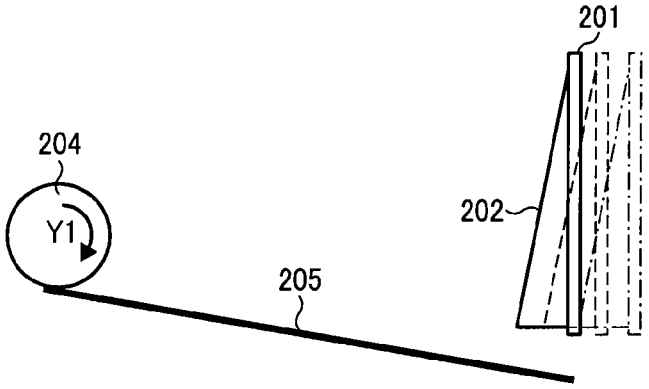
FIG. 16 is another side view illustrating the relative positions of the vibration plate and the agitator according to the first embodiment.

FIG. 16 is a side view of the agitator 205, in which the agitator 205 is positioned further downstream in the direction indicated by arrow Y1 from the position illustrated in FIG. 14.

In FIG. 16, broken lines represents the position of the vibration plate 201 being in the stationary state, and alternate long and short dashed lines represent the position of the vibration plate 201 illustrated in FIG. 14. When the vibration energy, which has been accumulated by the agitator 205 pushing the vibration plate 201, is released, the vibration plate 201 deforms to the opposite side as represented by solid lines in FIG. 16.

Figure 17:
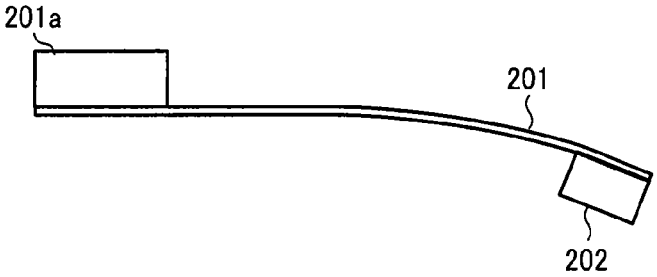
FIG. 17 is a top view illustrating vibration of the vibration plate according to the first embodiment.

FIG. 17 is a top view of vibration plate 201 in the state illustrated in FIG. 16.

As illustrated in FIG. 16, when the pushing force given to the projection 202 by the agitator 205 is released, owing to the energy of deformation accumulated in the vibration plate 201, the free end of the vibration plate 201, provided with the projection 202, deforms and moves to the opposite side.

In the state illustrated in FIGS. 16 and 17, the vibration plate 201 is away from the magnetic flux sensor 10, which faces the vibration plate 201 via the housing 200*a* of the sub-hopper 200. Subsequently, while the vibration plate 201 repeatedly approaches, by vibration, the magnetic flux sensor 10 further from the stationary state and moves, by vibration, away therefrom further from the stationary state, the vibration plate 201 returns to the stationary state as the vibration attenuates.

Figure 18:
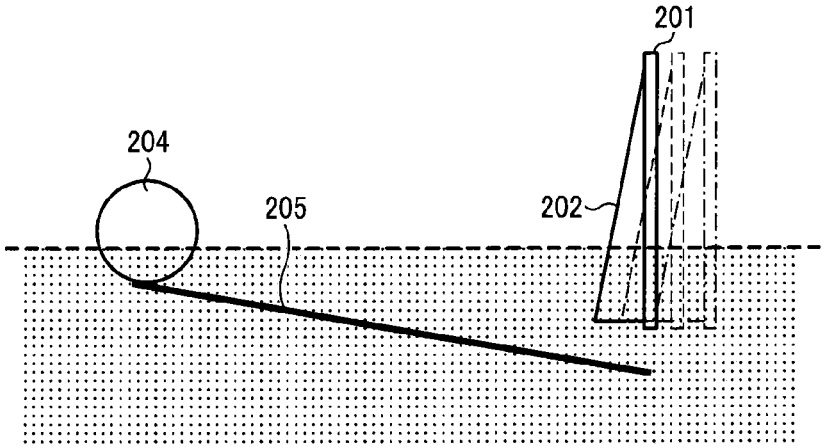
FIG. 18 is a side view illustrating the relation between the vibration of the vibration plate and developer, according to the first embodiment.

FIG. 18 schematically illustrates a state of toner (represented by dots) stored in the sub-hopper 200.

When toner is present in the sub-hopper 200 as illustrated in FIG. 18, the vibration plate 201 and the projection 202 contact the toner while vibrating. Accordingly, compared with a state in which toner is not present in the sub-hopper 200, the vibration of the vibration plate 201 attenuates early. According to changes in attenuation of vibration, the amount of remaining toner in the sub-hopper 200 is detected.

Figure 19:
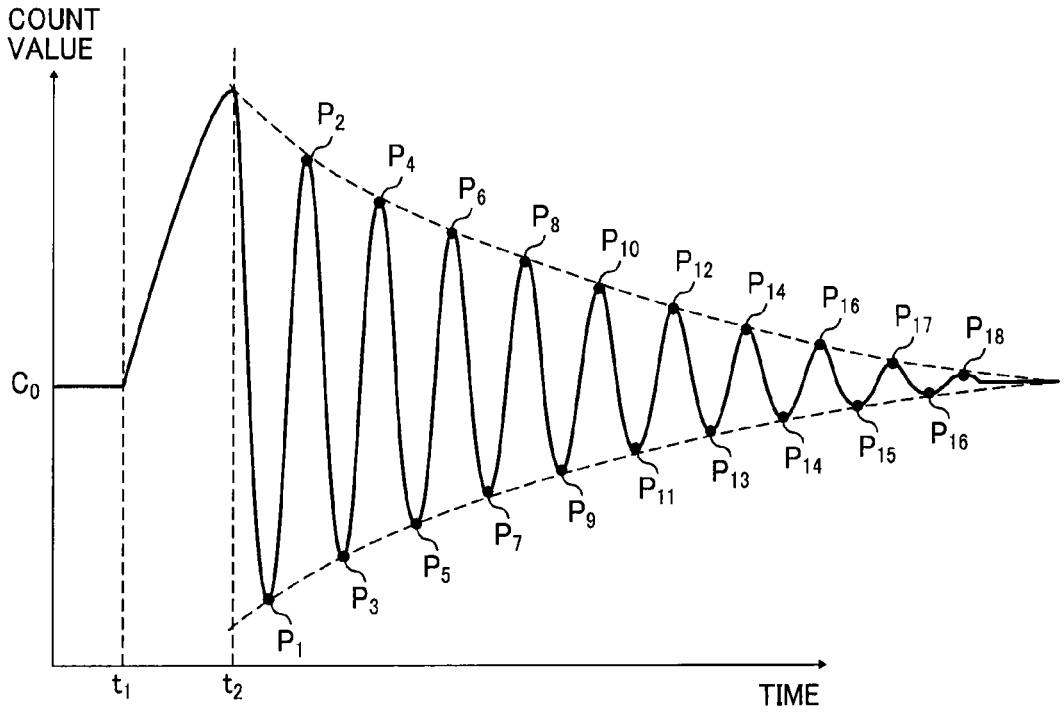
FIG. 19 is a graph of changes over time in oscillation frequency of the magnetic flux sensor corresponding to attenuation of vibration of the vibration plate, common to the first, second, and third embodiments.

FIG. 19 is a graph of changes in the count value of the oscillation signal from the magnetic flux sensor 10 per counting period from when the agitator 205 flips the projection 202 until the vibration of the vibration plate 201 attenuates to cease. Reference $C_0$ represents the count value at a neutral state.

The count value of the oscillation signal increases as the oscillation frequency becomes higher. Accordingly, as the ordinate in FIG. 19, the count value is replaceable with the oscillation frequency.

As illustrated in FIG. 19, at Time point $t_1$, the agitator 205 contacts and pushes the projection 202, and the vibration plate 201 approaches the magnetic flux sensor 10. Then, the oscillation frequency of the magnetic flux sensor 10 increases, and the count value per counting period increases.

At Time point $t_2$, the pushing of the projection 202 by the agitator 205 is released. Subsequently, the vibration plate 201 vibrates owing to the accumulated vibration energy. As the vibration plate 201 vibrates, the distance between the magnetic flux sensor 10 repeatedly increases and decreases from that distance in the stationary state. Consequently, the frequency of the oscillation signal of the vibration plate 201 fluctuates inherent to the vibration of the vibration plate 201, and the count value per counting period fluctuates similarly.

The amplitude of vibration of the vibration plate 201 becomes narrower as the vibration energy is consumed. That is, the vibration of the vibration plate 201 attenuates with elapse of time. Accordingly, the change in distance between the vibration plate 201 and the magnetic flux sensor 10 decreases with elapse of time. Similarly, the change in count value changes with elapse of time.

As described above, the vibration of the vibration plate 201 attenuates earlier when the amount of toner remaining in the sub-hopper 200 is greater. Accordingly, how the vibration of the vibration plate 201 attenuates is recognizable by analyzing the manner of attenuation of the oscillation of the signal output from the magnetic flux sensor 10 illustrated in FIG. 19. Then, the amount of toner remaining in the sub-hopper 200 is recognizable.

Referring to FIG. 19, when $P_1$, $P_2$, $P_3$, $P_4$ . . . represent the peaks of the count values of the oscillation signal, respectively, an attenuation ratio $\zeta$ of the vibration of the vibration plate 201 can be obtained by, for example, Formula 2 below. By referring to the change ratio between one peak value and another peak value acquired at different time points as expressed by Formula 2, errors caused by environmental changes are canceled, thereby attaining more accurate attenuation ratio. Specifically, in Formula 2, the ratio between the difference between Peaks $P_1$ and $P_2$, and the difference between Peaks $P_5$ and $P_6$ is calculated. In other words, the CPU 21 according to the present embodiment obtains the attenuation ratio (based on the ratio of the count values acquired at different time points.

$$\zeta = \frac{P_6 - P_5}{P_2 - P_1} \qquad \text{Formula 2}$$

It is to be noted that, although Formula 2 above uses Peaks $P_1$ and $P_2$, and Peaks $P_5$ and $P_6$ out of the peaks illustrated in FIG. 19, this is an example, and other peaks may be used instead. However, it is preferred to exclude the peak at Time point $t_2$, at which the vibration plate 201 pushed by the agitator 205 is closest to the magnetic flux sensor 10 since this peak includes error. For example, the friction between the agitator 205 and the projection 202 causes a sliding noise, which is superimposed on the peak.

Even if the toner in the sub-hopper 200 accelerates the attenuation of the vibration, as illustrated in FIG. 18, the vibration frequency of the vibration plate 201 does not change significantly. Accordingly, by calculating the ratio between the amplitude of specific peaks as expressed in Formula 2, the attenuation of amplitude in the specific period can be calculated.

Next, descriptions are given below of detection of amount of toner remaining in the sub-hopper 200 according to the present embodiment with reference to FIG. 20.

Figures 20, 21:
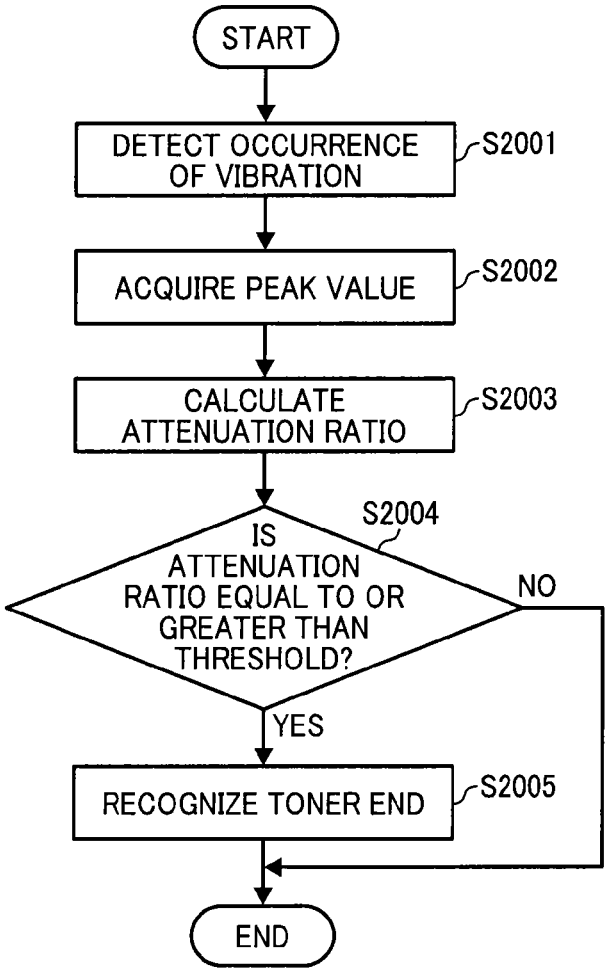
FIG. 20 is a flowchart of detection of toner remaining amount common to the first, second, and third embodiments.
FIG. 21 is a table of data in count value analysis according to an embodiment.

FIG. 20 illustrates a flow of actions of the CPU 21 illustrated in FIG. 8. As illustrated in FIG. 20, at S2001, the CPU 21 detects the occurrence of vibration as the agitator 205 pushes the projection 202 as illustrated in FIG. 14.

As described above, the CPU 21 acquires, from the count value output 33, the count value of the signal output from the magnetic flux sensor 10 per counting period. In the stationary state, the count value $C_0$ illustrated in FIG. 19 is obtained. By contrast, as the projection 202 is pushed as illustrated in FIG. 14 and the vibration plate 201 approaches the magnetic flux sensor 10 accordingly, the count value increases. Accordingly, at S2001, the CPU 21 detects the occurrence of vibration when the count value acquired from the count value output 33 exceeds the threshold.

Regardless of step S2001, the CPU 21 keeps acquiring the count value per counting period. At S2002, the CPU 21 acquires the peak value of fluctuation of the count value, which accords with the vibration of the vibration plate 201 illustrated in FIG. 19. The CPU 21 continuously analyzes the count value acquired in each counting period, thereby identifying the peak.

FIG. 21 is a table of data of count analysis.

The data in FIG. 21 include "number n", "count value $S_n$" acquired in each counting period, and the sign (+ or −) of the difference ($S_{n-1}-S_n$) between each count value $S_n$ and the immediately preceding count value $S_{n-1}$. The "number n", "count value $S_n$", and the sign (+ or −) are arranged in the order of acquisition. In the data illustrated in FIG. 21, the peak is immediately before the sing of "$S_{n-1}-S_n$" is inverted. In the case illustrated in FIG. 21, "5" and "10" in the number n are adopted as peaks.

That is, subsequent to S2001, the CPU 21 calculates "$S_{n-1}-S_n$" regarding the count values sequentially acquired. The count value Sn of the number n immediately before the sign of "$S_{n-1}-S_n$" is inverted is adopted as $P_1$, $P_2$, $P_3$ . . . illustrated in FIG. 19.

As described above, it is preferred to avoid the count value at Timing $t_2$, which is an initial peak after the step S2001. Accordingly, the CPU 21 discards the initial peak out of the extracted peaks through the analysis illustrated in FIG. 22.

Figure 22:
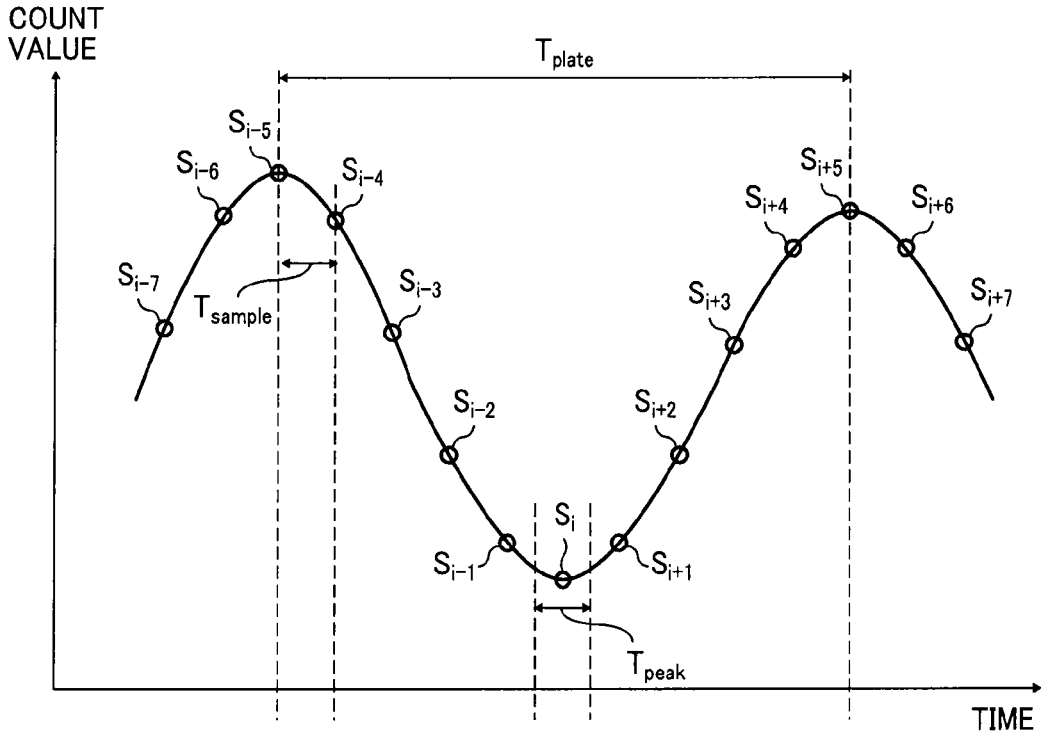
FIG. 22 is a chart illustrating the relation between a count value sampling cycle and a vibration cycle of the vibration plate common to the first, second, and third embodiments.

Additionally, in practice, it is possible that the count value include noise of high frequency component, and the sign of "$S_{n-1}-S_n$" may be inverted at a timing different from the timing at which the vibration of the vibration plate 201 is at its peak. To avoid erroneous detection in such cases, it is preferred that the CPU 21 smooth the values acquired from the count value output 33 before analyzing the values as illustrated in FIG. 22. The acquired values can be smoothed through typical methods such as moving average.

Using the peaks thus obtained, at S2003, the CPU 21 calculates the attenuation ratio ζ using Formula 2 mentioned above. For that, the count value analysis illustrated in FIG. 21 is continued at S2002 until the peaks used in the attenuation ratio calculation are attained. In the case of Formula 2, the CPU 21 analyzes the count values until the peak value equivalent to Peak $P_6$ is attained.

At S2004, the CPU 21 determines whether the attenuation ratio calculated at S2003 is equal to or smaller than the threshold. In other words, the CPU 21 determines whether the amount of toner in the sub-hopper 200 is below the predetermined amount based on the comparison between the difference of the count values acquired at different time points and the threshold. As described above with reference to FIG. 18, when a sufficient amount of toner is in the sub-hopper 200, the vibration of the vibration plate 201 attenuates early, and the attenuation ratio ζ is smaller.

By contrast, as the amount of toner in the sub-hopper 200 decreases, the speed of attenuation of the vibration of the vibration plate 201 becomes slower, and the attenuation ratio ζ increases. Accordingly, when the threshold is set to the attenuation ratio ζs corresponding to the amount of remaining toner to be detected, whether the amount of toner remaining in the sub-hopper 200 falls to the amount to be detected (hereinafter "prescribed amount") can be determined based on the calculated attenuation ratio ζ.

It is to be noted that the amount of toner remaining in the sub-hopper 200 does not directly affect the manner of attenuation of vibration of the vibration plate 201. According to the amount of remaining toner, the manner of contact of toner with the vibration plate 201 changes, and the manner of contact defines the manner of attenuation of vibration of the vibration plate 201. Therefore, even if the amount of toner remaining in the sub-hopper 200 is the same, the vibration of the vibration plate 201 attenuates differently depending on the manner of contact between the vibration plate 201 and toner.

In the present embodiment, the agitator 205 constantly stirs the toner in the sub-hopper 200, the amount of which is to be detected. Accordingly, to a certain degree, the state of contact of toner with the vibration plate 201 is determined with the amount of remaining toner. This configuration can avoid the inconvenience that the detection result differs depending on the manner of contact between the vibration plate 201 and toner even if the remaining amount is the same.

When the CPU 21 determines that the calculated attenuation ratio ζ is below the threshold (No at S2004), the CPU 21 determines that the amount of toner in the sub-hopper 200 is sufficient and completes the processing. By contrast, when the calculated attenuation ratio ζ is equal to or greater than the threshold (Yes at S2004), the CPU 21 determines that the amount of toner in the sub-hopper 200 is below the prescribed amount and, at S2005, recognizes the toner end in the sub-hopper 200. Then, the processing is completed.

Recognizing the toner end at S2005, the CPU 21 outputs a signal indicating that the amount of remaining toner is below the prescribed amount, to an upper level controller to control the image forming apparatus 100. With this signal, the controller of the image forming apparatus 100 recognizes the end of toner of specific color and becomes capable of supplying toner from the toner bottle 117.

Next, descriptions are given below of the relation among the oscillation frequency of the magnetic flux sensor 10, the cycle in which the CPU 21 acquires the count values (hereinafter "sampling cycle"), and the eigenfrequency of the vibration plate 201.

FIG. 22 is a chart of count values sampled regarding a single vibration cycle of the vibration plate 201. In FIG. 22, the vibration cycle of the vibration plate 201 is represented by "$T_{plate}$", and the sampling cycle is represented by "$T_{sample}$".

To calculate, at a higher degree, the attenuation ratio ζ of the vibration of the vibration plate 201 through the method illustrated in FIGS. 19 through 21, it is necessary to acquire the peak value of vibration of the vibration plate 201 accurately. For that, it is preferred that the number of sampled count values in the vibration cycle $T_{plate}$ be sufficient, and the sampling cycle $T_{sample}$ be small enough relative to the vibration cycle $T_{plate}$.

In the case illustrated in FIG. 22, the count values $S_{i-5}$ to $S_{i+5}$ are sampled in one vibration cycle $T_{plate}$, and the number of count values ($S_i$) sampled is 10. That is, the sampling cycle $T_{sample}$ is 1/10 of the vibration cycle $T_{plate}$. In the case illustrated in FIG. 22, the count value $S_i$ is inevitably sampled during a peak period $T_{peak}$ of the count value, and thus the peak value can be acquired with a higher degree of accuracy.

Accordingly, for example, when the sampling cycle $T_{sample}$ for the CPU 21 to acquire the count values is 1 ms, the vibration cycle $T_{plate}$ of the vibration plate 201 is preferably 10 ms or greater. In other words, regarding a sampling frequency 1000 Hz of the CPU 21, the eigenfrequency of the vibration plate 201 is preferably about 100 Hz and, more preferably, not greater than 100 Hz. Such an eigenfrequency of the vibration plate 201 is attained by adjusting the material of the vibration plate 201, the dimension (including thickness) of the vibration plate 201, and the weight of the projection 202.

By contrast, if the count value acquired per each sampling cycle is too small, changes in the sampled count values corresponding to the vibration of the vibration plate 201 are small, and it becomes difficult to accurately calculate the attenuation ratio ζ. Here, the count value sampled conforms to the oscillation frequency of the magnetic flux sensor 10.

Typically, the oscillation frequency of the magnetic flux sensor 10 is of the order of several megahertz (MHz). When the sampling is performed at a sampling frequency of 1000 Hz, 1000 count values or greater are obtained at each sampling timing. According to the order of the vibration cycle $T_{plate}$ and the sampling cycle $T_{sample}$, the attenuation ratio ζ can be calculated accurately.

However, the amplitude of fluctuation of the count values relative to time illustrated in FIG. 19 is small if the change in the oscillation frequency of the magnetic flux sensor 10 is insufficient relative to the change in distance between the magnetic flux sensor 10 and the vibration plate 201. The change in distance therebetween is defined by the vibration of the vibration plate 201. As a result, the change in the attenuation ratio ζ also becomes smaller, thereby degrading the accuracy in detecting the amount of remaining toner, using the vibration of the vibration plate 201.

To increase the change in oscillation frequency of the magnetic flux sensor 10 corresponding to the change in distance between the magnetic flux sensor 10 and the vibration plate 201, the distance therebetween is determined based on the characteristics illustrated in FIG. 11. For example, it is preferred that the distance between the magnetic flux sensor 10 and the vibration plate 201 (in the stationary state) be set to the distance that corresponds to the range in which the oscillation frequency changes steeply corresponding to the distance therebetween, such as the range FL in FIG. 11.

Figure 23:
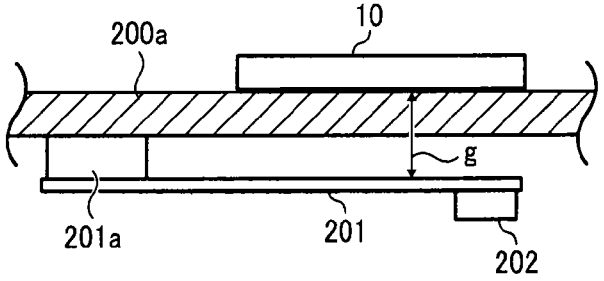
FIG. 23 illustrates a distance of the magnetic flux sensor and the vibration plate common to the first, second, and third embodiments.

FIG. 23 is a view illustrating adjustment of the distance between the magnetic flux sensor 10 and the vibration plate 201.

As illustrated in FIG. 23, a distance g between the magnetic flux sensor 10 and the vibration plate 201 in the stationary state is adjustable with the thickness of the housing 200*a* of the sub-hopper 200, to which the magnetic flux sensor 10 and the vibration plate 201 are secured, and the thickness of the mount 201*a*, to which the vibration plate 201 is mounted.

In the above-described method according to the present embodiment, the effect of toner on the vibration of the vibration plate 201, which is a delicate phenomenon, is detected to detect the amount of remaining toner. This method is advantageous over a method in which the pressure of toner or the like is directly detected. Since the state of toner is detected via the vibration of the vibration plate 201, this method enables accurate detection of toner remaining amount without using a pressure sensor, the accuracy of which is not easily enhanced.

Additionally, the present embodiment is on the premise that the vibration plate 201 being sensed by the magnetic flux sensor 10 is vibrating. Therefore, even if toner is on the vibration plate 201, the toner is shaken off the vibration plate 201 as the vibration plate 201 vibrates. Thus, degradation of detection accuracy caused by toner adhesion is inhibited.

Additionally, it is not necessary that the magnetic flux sensor 10 physically contacts the vibration plate 201 being sensed. Even if the magnetic flux sensor 10 is disposed outside the toner container (sob-hopper 200 in the present embodiment), it is not necessary to make a hole in the housing to attain physical access. Thus, attachment of components is easy, thereby improving productivity.

Additionally, according to the present embodiment, as presented as S2001 in FIG. 20, the detection of toner remaining amount is triggered when the vibration plate 201 moves, pushed by the agitator 205, and the toner remaining amount is detected by acquiring the subsequent peak values. Accordingly, detection results of toner remaining amount are not attained in the state illustrated in FIG. 14, in which the vibration plate 201 is pushed by the agitator 205.

By contrast, in the method that employs a pressure sensor or the like to detect pressure corresponding to the toner remaining amount, it is difficult to distinguish the pressure caused by the agitator 205 stirring the toner inside the toner container from the pressure corresponding to the toner remaining amount. Thus, it is difficult to improve the detection accuracy. Such inconveniences are eliminated in the present embodiment.

It is to be noted that, although the above-described embodiment employs the vibration plate 201 that is planar and made of metal, this is just an example. Requisites of the vibration plate 201 include generating vibration at a desired vibration frequency as described with reference to FIG. 22, affecting the magnetic flux corresponding to the distance from the magnetic flux sensor 10, and affecting the frequency of oscillation signal of the magnetic flux sensor 10 accordingly.

The description above concerns use of a metal component that cancels the magnetic flux, thereby reducing the inductance L, as the metal component approaches the magnetic flux sensor 10. Alternatively, another embodiment employs a ferromagnetic component, which increases the magnetic flux, thereby increasing the inductance L, as the ferromagnetic component approaches the magnetic flux sensor 10.

In the above-described embodiment, the target sensed by the magnetic flux sensor 10 is planar (i.e., the vibration plate 201) from the standpoint of effects on magnetic flux generated by the coil pattern 11 of the magnetic flux sensor 10 and the standpoint of eigenfrequency. However, the target sensed by the magnetic flux sensor 10 is not limited to the planar component but can be, for example, a rod as long as the rod vibrates and affects the magnetic flux.

Additionally, in the description above, the vibration plate 201 is made of a material that affects the magnetic flux, and the attenuation of vibration of the vibration plate 201 is detected by the magnetic flux sensor 10. However, this is just an example, and the material is not limited thereto as long as the toner remaining amount in the toner container is detectable based on the effects of toner on the vibration of the planar component, which is a delicate phenomenon.

Additionally, the above-described prescribed amount is adjustable with the placement of the vibration plate 201 and the magnetic flux sensor 10 in the sub-hopper 200.

Figure 24:
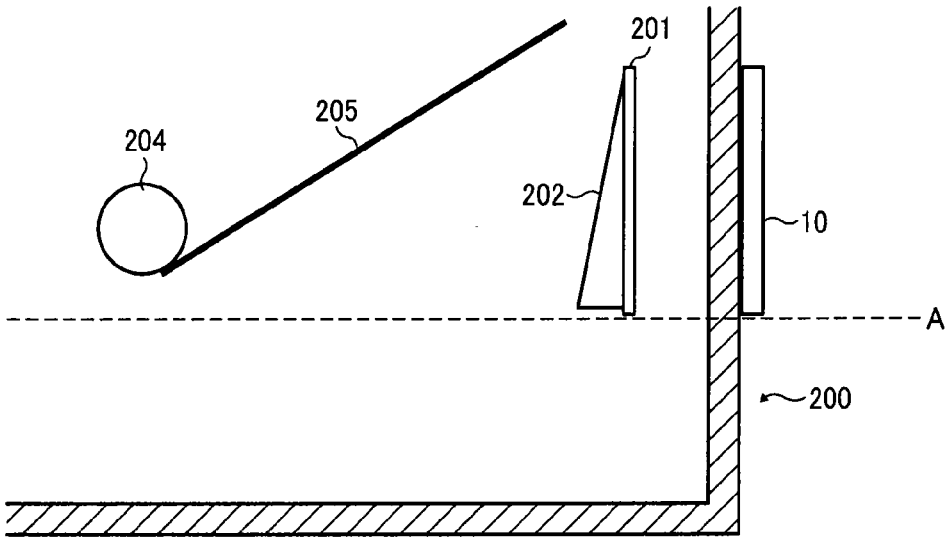
FIG. 24 is a view illustrating heights of the vibration plate and the magnetic flux sensor secured in the sub-hopper common to the first, second, and third embodiments.
Figure 25:
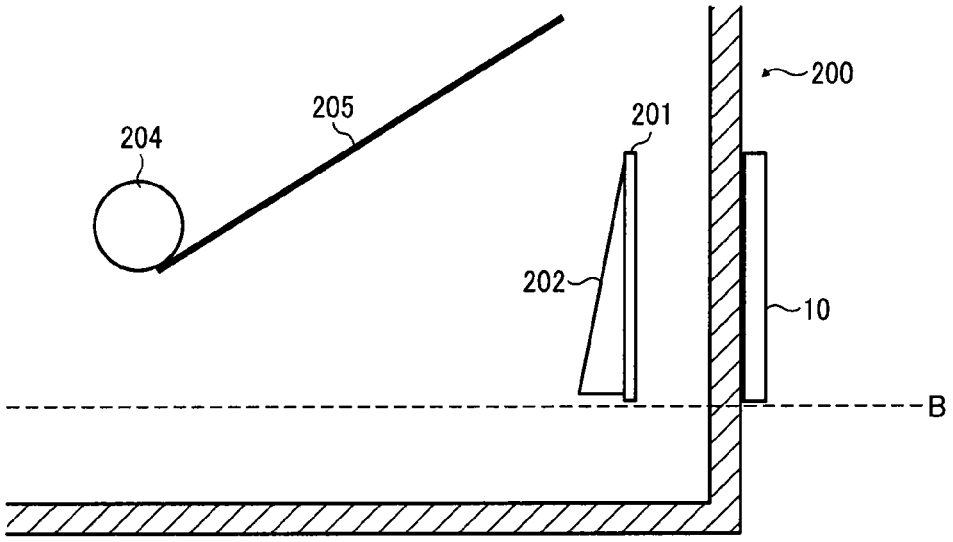
FIG. 25 is a another view illustrating heights of the vibration plate and the magnetic flux sensor secured in the sub-hopper, common to the first, second, and third embodiments.

FIGS. 24 and 25 are views illustrating the relation between the placement of the vibration plate 201 and the magnetic flux sensor 10 in the sub-hopper 200 and the prescribed amount.

In the case illustrated in FIG. 24, toner does not contact the vibration plate 201 when the level (height) of toner in the sub-hopper 200 falls below a height A indicated by broken lines in FIG. 24. Accordingly, when the level of toner is around the height A, the CPU 21 recognizes that the toner remaining amount falls below the prescribed amount.

By contrast, in the case illustrated in FIG. 25, the vibration plate 201 and the magnetic flux sensor 10 are at positions lower than those illustrated in FIG. 24. Toner does not contact the vibration plate 201 when the level (height) of toner in the sub-hopper 200 falls below a height B indicated by broken lines in FIG. 25. Accordingly, when the level of toner is around the height B, it is deemed that the toner remaining amount is below the prescribed amount.

For example, to adjust the manners to supply cyan, magenta, yellow, and black toners, the prescribed amount is adjusted with the placement of the vibration plate 201 and the magnetic flux sensor 10. For example, regarding a frequently used color among cyan, magenta, yellow, and black, the vibration plate 201 and the magnetic flux sensor 10 are disposed at higher positions as illustrated in FIG. 24. By contrast, regarding the color used less frequently, the vibration plate 201 and the magnetic flux sensor 10 are disposed at lower positions as illustrated in FIG. 25. With such adjustment, toner can be supplied efficiently corresponding to the frequency of use.

Additionally, although the description above concerns the detecting mechanism including the magnetic flux sensor 10 and the vibration plate 201 to detect the amount of toner remaining in the sub-hopper 200 illustrated in FIG. 2, this detecting mechanism can be widely used to detect the amount of powder such as toner. For example, the detecting mechanism is used to detect the amount of toner remaining in the developing device 112 in another embodiment.

Figure 26:
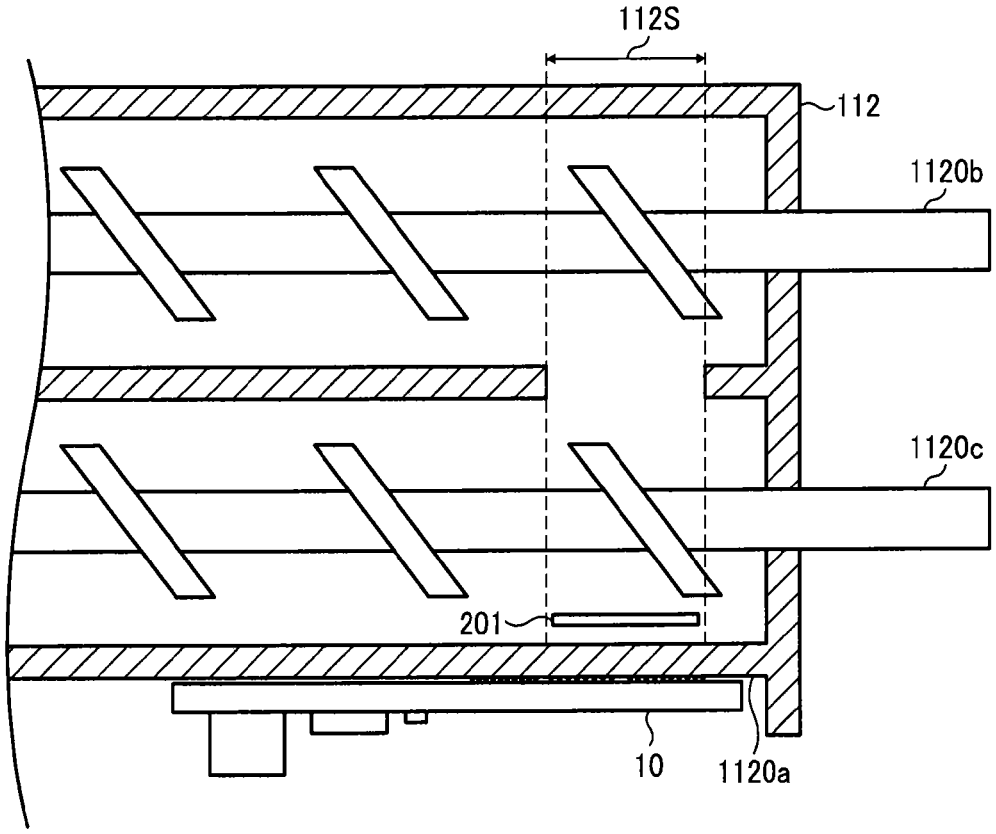
FIG. 26 is a cross-sectional view illustrating placement of the magnetic flux sensor and the vibration plate disposed in the developing device, according to an embodiment.

FIG. 26 is a cross-sectional view of the developing device 112 in that case. Inside the developing device 112, a supplying screw 1120*b* and a collecting screw 1120*c* transport toner by rotation.

The supplying screw 1120*b* and the collecting screw 1120*c* serve as developer conveyors and transport toner in the main scanning direction entirely in the developing device 112. The developer conveyors are not limited to screws but can be augers, coils, or paddles.

When the detecting mechanism including the magnetic flux sensor 10 and the vibration plate 201 is applied to the developing device 112, as illustrated in FIG. 26, the magnetic flux sensor 10 is attached to the developing device 112 such that the board face bearing the coil pattern 11 faces a sensor mounting portion 1120*a* in the developing device 112. With this placement, as illustrated in FIG. 26, the coil pattern 11 is disposed facing a communicating space 112S through which a developer conveyance passage by the collecting screw 1120*c* communicates with a developer conveyance passage by the supplying screw 1120*b*.

Inside the developing device 112, the vibration plate 201 is disposed in the communicating space 112S. Similar to the vibration plate 201 disposed in the sub-hopper 200, the vibration plate 201 disposed in the developing device 112 vibrates, flipped by the collecting screw 1120*c* that rotates. With this action, similar to the above-described embodiment, the magnetic flux sensor 10 can detect the vibration of the vibration plate 201.

Since toner moves between the developer conveyance passage by the collecting screw 1120*c* and the developer conveyance passage by the supplying screw 1120*b*, the toner remains longer in the communicating space 112S than those conveyance passages, and the toner is denser in the communicating space 112S. Accordingly, the effects of toner on the vibration of the vibration plate 201 are increased by disposing the vibration plate 201 in the communicating space 112S, and thus the amount of toner remaining in the developing device 112 can be detected with a higher degree of accuracy.

Additionally, although the description above concerns detection of amount of toner (i.e., developer) used in electrophotographic image forming apparatuses, the target of remaining amount detection is not limited thereto. The aspects of this specification can adapt to detection of any powder as long as the powder affect the vibration of the vibration plate 201 and has flowability to affect the vibration of the vibration plate 201 corresponding to the remaining amount. For example, the target of remaining amount detection can be premixed developer, in which toner is premixed with carrier. Further, the target of remaining amount detection is not limited to powder but can be any substance having flowability to affect the vibration of the vibration plate 201 corresponding to the remaining amount. For example, the target of remaining amount detection can be liquid.

Further, although the attenuation ratio ζ is calculated using Formula 2 in the embodiment described above, this is an example. Alternatively, for example, as expressed by Formula 3 below, an average of attenuation ratios between multiple peaks can be used.

$$\zeta = \frac{1}{2}\left(\frac{P_4 - P_3}{P_2 - P_1} + \frac{P_8 - P_7}{P_6 - P_5}\right) \quad \text{Formula 3}$$

Yet alternatively, as expressed by Formula 4 below, simply the ratio between the multiple peaks can be used.

$$\zeta = \frac{P_6}{P_2} \quad \text{Formula 4}$$

In the embodiment described above, a planar pattern coil printed on the board is used. The planar coil (i.e., in a planar pattern of wire) is advantageous in reducing the size (thickness) in the direction in which the coil faces the vibration plate 201 to be sensed, thereby making the apparatus compact.

However, similar effects are available with a coil configured to generate a magnetic flux in the direction in which the coil faces the vibration plate 201 even if the coil is not shaped in a planar pattern.

Figure 27:
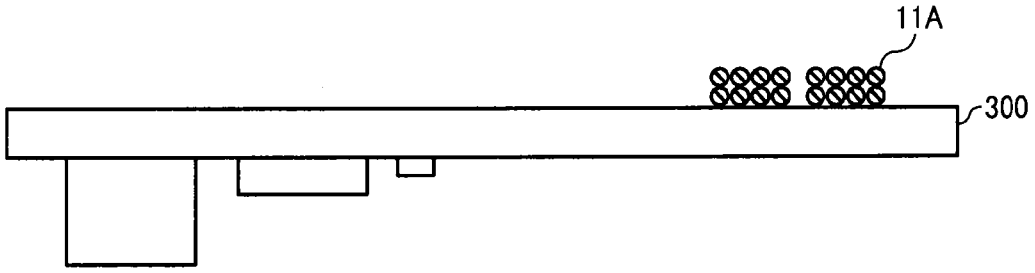
FIG. 27 is a side view illustrating a shape of a coil according to another embodiment.
Figure 28:
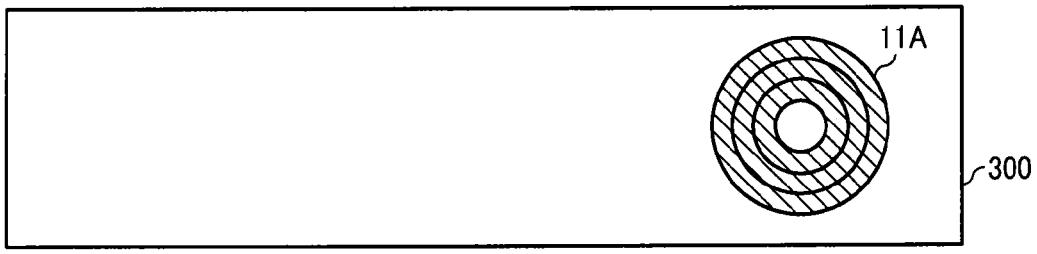
FIG. 28 is a front view of the coil illustrated in FIG. 27.

FIGS. 27 and 28 illustrate another configuration of the coil. FIG. 27 is a side view of a coil 11A as viewed in a direction parallel to the board face of the board 300. FIG. 28 is a view of the coil 11A as viewed in a direction perpendicular to the board face of the board 300.

The configuration illustrated in FIGS. 27 and 28 includes the coil 11A produced by winding wire on the board 300 serving as the magnetic flux sensor 10. A surface of the coil 11A is insulated. In the configuration illustrated in FIGS. 27 and 28 as well, the thickness of the coil 11A can be kept thin by selecting wire type, and the device can be kept compact.

Next, descriptions are given below of a manner of attachment of the vibration plate 201, the mount 201*a*, and the projection 202 (hereinafter collectively "vibration structure 210") as well as the magnetic flux sensor 10 according to the present embodiment, with reference to FIGS. 29A though 29D.

Figure 29A:
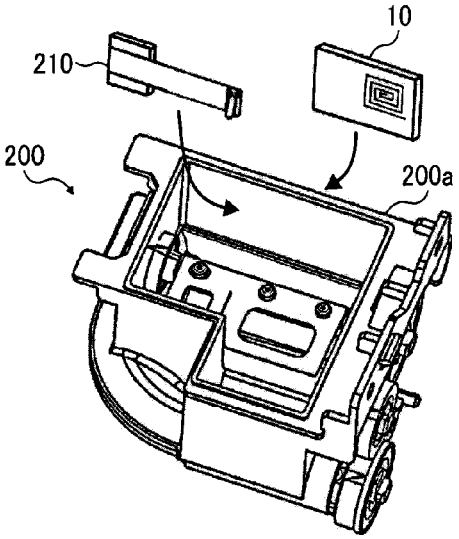
FIGS. 29A, 29B, 29C, and 29D illustrate placement of a vibration structure and the magnetic flux sensor according to the first embodiment.
Figure 29B:
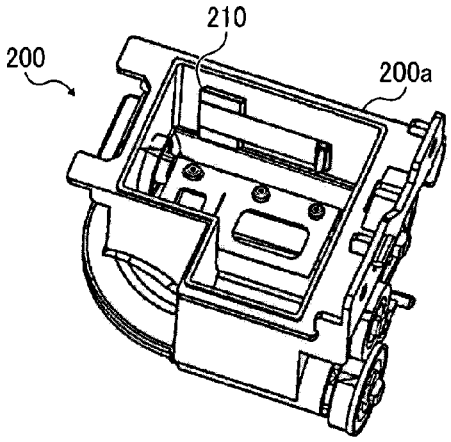
Figure 29C:
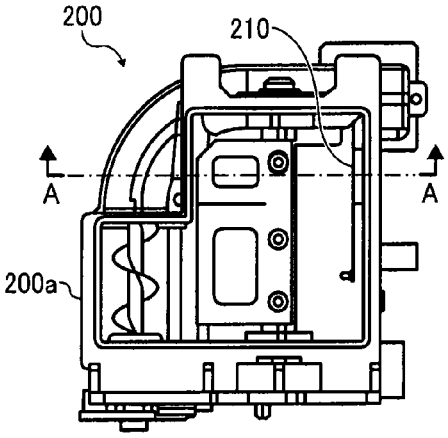
Figure 29D:
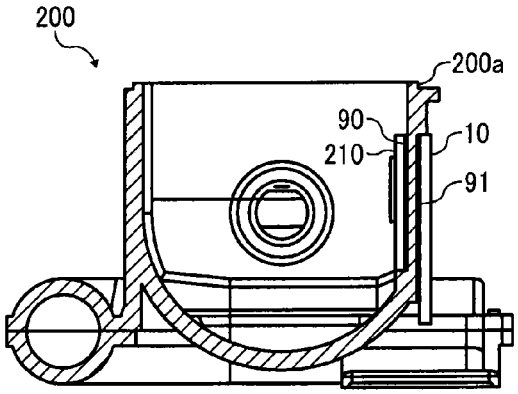

FIG. 29A is a perspective view of the sub-hopper 200 before the vibration structure 210 and the magnetic flux sensor 10 are attached thereto. FIG. 29B is a perspective view of the sub-hopper 200 with the vibration structure 210 and the magnetic flux sensor 10 attached thereto. FIG. 29C is a top view of the sub-hopper 200 with the vibration structure 210 and the magnetic flux sensor 10 attached thereto. FIG. 29D is a cross-sectional view along line A-A in FIG. 29C.

As illustrated in FIGS. 29A and 29B, in the present embodiment, the vibration structure 210 is secured to the inner face of the housing 200*a* of the sub-hopper 200, and the magnetic flux sensor 10 is secured to the outer face of the housing 200*a*. As illustrated in FIGS. 29C and 29D, the vibration structure 210 faces the magnetic flux sensor 10 via the housing 200*a*.

In the manner of attachment illustrated in FIGS. 29A through 29D, the vibration structure 210 and the magnetic flux sensor 10 are bonded to the housing 200*a* via adhesive layers 90 and 91. Compared with attachment using fastenings such as screws, pins, and the like, the manner illustrated in FIGS. 29A through 29 eliminates the necessity of forming through holes in the housing 200*a* for the fastenings. Obviating the through holes is advantageous in that toner does not leak from the through holes, and thus toner is inhibited from scattering outside the sub-hopper 200. In the area of the wall of the housing 200*a*, in which the vibration structure 210 and the magnetic flux sensor 10 are attached, the wall has no through holes for the fastenings. In other words, the space in which the vibration structure 210 is disposed is isolated by the wall from the space in which the magnetic flux sensor 10 is disposed in the direction in which the vibration structure 210 faces the magnetic flux sensor 10. Accordingly, leak of toner is inhibited.

Additionally, in the manner of attachment illustrated in FIGS. 29A through 29D, in which fastenings such as screws are not used, the number of components is smaller, thereby reducing the cost of the device, and the attachment is easier, thereby enhancing the productivity. Additionally, the manner of attachment illustrated in FIGS. 29A through 29D does not require seals to cover the through holes, thereby further reducing the cost and simplifying the assembling of the sub-hopper 200 compared with a configuration that includes the through holes and the seals to cover the through holes.

In FIGS. 29A through 29D, the vibration plate 201, the mount 201*a*, and the projection 202 are united together into the vibration structure 210, and then the united vibration structure 210 is attached to the sub-hopper 200. In another embodiment, the mount 201*a*, the vibration plate 201, and the projection 202 are sequentially attached to the sub-hopper 200 in that order. For example, the mount 201*a* and the projection 202 are attached to the vibration plate 201 by welding, caulking, bonding, or the like.

Figure 30A:
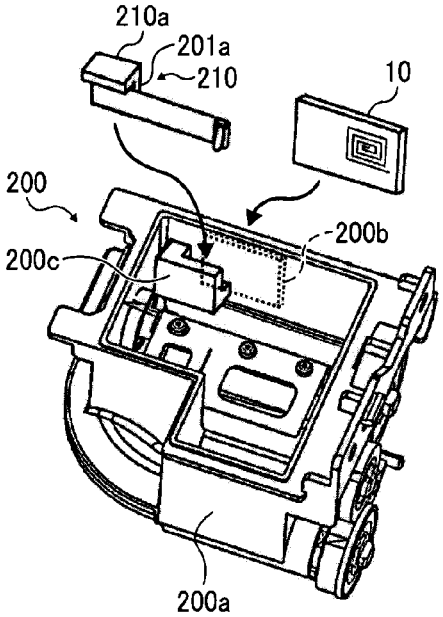
FIGS. 30A, 30B, 30C, and 30D illustrate placement of the vibration structure and the magnetic flux sensor according to the first embodiment.
Figure 30B:
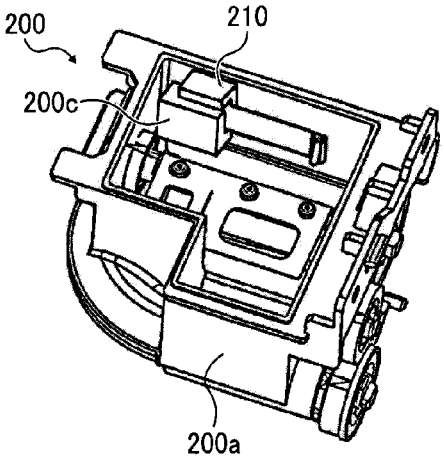
Figure 30C:
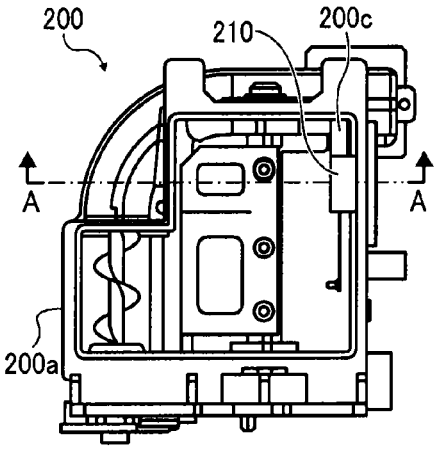
Figure 30D:
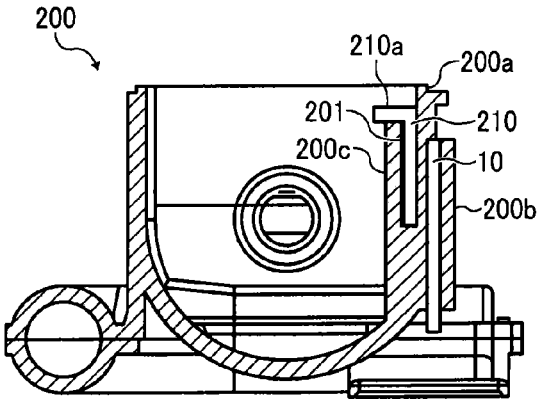

Next, descriptions are given below of another manner of attachment of the vibration structure 210 and the magnetic flux sensor 10 with reference to FIGS. 30A though 30D. FIG. 30A is a perspective view of the sub-hopper 200 before the vibration structure 210 and the magnetic flux sensor 10 are attached thereto. FIG. 30B is a perspective view of the sub-hopper 200 with the vibration structure 210 and the magnetic flux sensor 10 attached thereto. FIG. 30C is a top view of the sub-hopper 200 with the vibration structure 210 and the magnetic flux sensor 10 attached thereto. FIG. 30D is a cross-sectional view along line A-A in FIG. 30C.

The manner illustrated in FIGS. 30A through 30D involves fitting the vibration structure 210 and the magnetic flux sensor 10 in ribs (i.e., recesses). Specifically, as illustrated in FIG. 30A, a rib 200*b* is disposed on the outer face of the housing 200*a* of the sub-hopper 200, and a rib 200*c* is disposed on the inner face of the housing 200*a*.

As illustrated in FIG. 30A, the vibration structure 210 is fitted in the rib 200*c* to secure the vibration structure 210 inside the sub-hopper 200. As illustrated in FIG. 30D, the magnetic flux sensor 10 is fitted in the rib 200*b* to secure the magnetic flux sensor 10 to the outer wall of the sub-hopper 200.

The manner illustrated in FIGS. 30A through 30D inhibits scattering of toner, similarly, since the housing 200*a* of the sub-hopper 200 does not include the through holes for the attachment. Similarly, since screwing or the like is not involved, assembling is easier. Additionally, since the fastenings and the seals to cover the through holes are obviated, the number of components is smaller, and the cost is reduced.

As illustrated in FIGS. 30A and 30D, the mount 201*a* to hold the vibration plate 201 includes a flat portion 210*a*, which is shaped like a hook bent from an upper end of the mount 201*a*. In other words, in a state in which the vibration structure 210 is fitted in the rib 200*c*, the flat portion 210*a* provides a face substantially vertical to the direction in which the vibration structure 210 is fitted into the rib 200*c*.

The flat portion 210*a* serves as a pressed portion to be pressed by a worker while the worker fits the vibration structure 210 into the rib 200*c*. Thus, the attachment of the vibration structure 210 is facilitated.

In another embodiment, the magnetic flux sensor 10 includes a portion equivalent to the flat portion 210*a* of the vibration structure 210. Such a configuration makes it easier to fit the magnetic flux sensor 10 into the rib 200*b*. In the manner illustrated in FIGS. 30A through 30D, the adhesive layers are eliminated, thereby reducing the cost and facilitating the assembling work.

Additionally, the manner using the adhesive layers illustrated in FIGS. 29A through 29D can be combined with the manner using fitting illustrated in FIGS. 30A through 30D. For example, while the vibration structure 210 is bonded to the housing 200*a*, the magnetic flux sensor 10 is fitted in the recess in the housing 200*a*. Alternatively, while the vibration structure 210 is fitted in the recess in the housing 200*a*, the magnetic flux sensor 10 is bonded to the housing 200*a*.

Additionally, in the manner illustrated in FIGS. 29A through 29D and the manner illustrated in FIGS. 30A through 30D, the mount 201*a* is attached to the vibration plate 201 to secure the clearance between the inner face of the housing 200*a* and the vibration plate 201. However, this is just an example. Alternatively, for example, the inner face of the housing 200*a* includes a mount equivalent to the mount 201*a* to hold the vibration plate 201.

Second Embodiment

In the first embodiment, the magnetic flux sensor 10 is attached to the outer face of the housing 200*a* of the sub-hopper 200 and used to detect the amount of toner (i.e., powder) remaining in the sub-hopper 200. In the second embodiment, the magnetic flux sensor 10 is attached to each of process cartridges 2106C, 2106M, 2106Y, and 2106K (collectively "process cartridges 2106") installable in and removable from the image forming apparatus 100. It is to be noted that elements similar to those of the first embodiment are given identical or similar reference characters, and thus descriptions thereof omitted.

Figure 31:
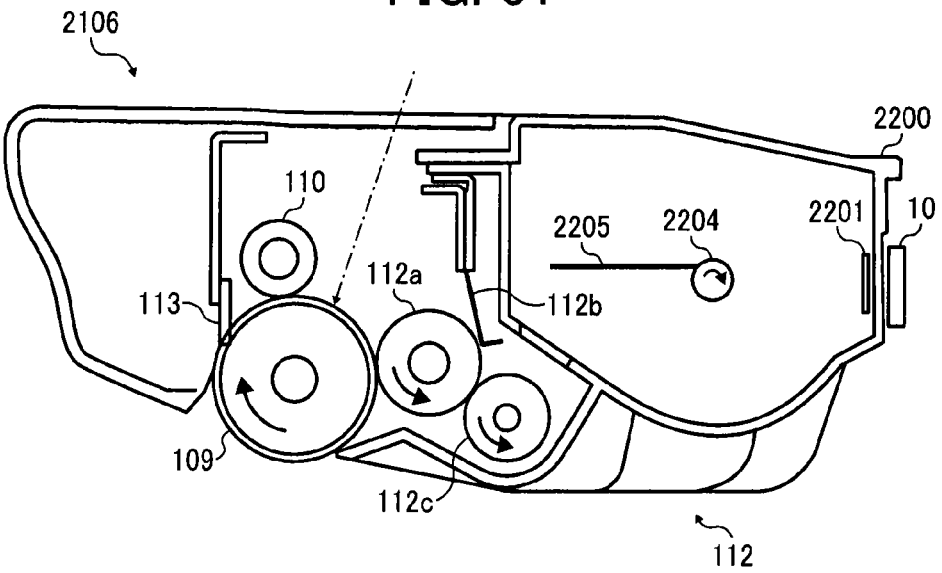
FIG. 31 is a schematic cross-sectional view of a process cartridge according to the second embodiment.

In the present embodiment, the components of the image forming unit 106 illustrated in FIG. 1 are united together into the process cartridge 2106. The process cartridges 2106 according to the present embodiment are described with reference to FIG. 31. The process cartridges 2106C, 2106M, 2106Y, and 2106K are similar in structure, and FIG. 31 illustrates one of them. As illustrated in FIG. 31, the relative positions of a vibration plate 2201 and the magnetic flux sensor 10 in a toner container 2200 are similar to those in the first embodiment. The second embodiment is different from the first embodiment in that the magnetic flux sensor 10 is attached to not the sub-hopper 200 but the process cartridge 2106.

The process cartridge 2106 (i.e., the image forming unit) includes the photoconductor drum 109 as well as the charging device 110, the developing device 112, and the photoconductor cleaner 113 disposed around the photoconductor drum 109. The charging device 110 is a roller in the present embodiment and rotates as the photoconductor drum 109 rotates. The photoconductor drum 109 rotates clockwise in FIG. 31.

As illustrated in FIG. 31, the developing device 112 includes a developing roller 112*a*, a doctor blade 112*b*, a supply roller 112*c*, and a toner container 2200. The developing roller 112*a* transports developer to the photoconductor drum 109 to develop the electrostatic latent image on the photoconductor drum 109. The developing roller 112*a* rotates counterclockwise in FIG. 31.

In the developing device 112, the doctor blade 112*b* levels the toner carried on the developing roller 112*a* to a predetermined height, and the developing roller 112*a* transports, by rotation, the toner to the photoconductor drum 109. Then, the toner is transferred from the developing roller 112*a* to the photoconductor drum 109 and adheres to the electrostatic latent image thereon.

The supply roller 112*c* supplies the toner from the toner container 2200 to the developing roller 112*a*. When no toner or almost no toner remains in the toner container 2200, toner is not supplied from the supply roller 112*c* to the developing roller 112*a*. An aspect of the present embodiment is to recognize that the amount of toner remaining in the toner container 2200 is small.

The magnetic flux sensor 10 is secured to an outer wall of a housing 2000 (casing) defining the toner container 2200. The vibration plate 2201 is secured to an inner face of the housing 2000. Specifically, the vibration plate 2201 is secured to the inner face on the back of the magnetic flux sensor 10 secured to the outer face of the wall of the housing 2000 in FIGS. 32A through 32D. Accordingly, the vibration plate 2201 is disposed facing the magnetic flux sensor 10.

Descriptions are given below of manner of attachment of the magnetic flux sensor 10 and the vibration plate 2201 with reference to FIGS. 32A though 32D. The vibration plate 2201 is planar and rectangle in the present embodiment. A first end of a long side of the vibration plate 2201 is secured to the housing 2000 of the toner container 2200, and a second end of the long side is not secured. Thus, the vibration plate 2201 is cantilevered. Additionally, a projection 2202, serving as a weight, is disposed at the second end of the long side of the vibration plate 2201. The projection 2202 is used for vibrating the vibration plate 2201 and for adjusting the vibration frequency when the vibration plate 2201 vibrates.

As illustrated in FIG. 31, a shaft 2204 and an agitator 2205 are disposed inside the toner container 2200 to stir the toner contained therein. The shaft 2204 rotates inside the toner container 2200. The agitator 2205 is secured to the shaft 2204. As the shaft 2204 rotates, the agitator 2205 stirs, by rotation, the toner contained inside the toner container 2200. The long side of the vibration plate 2201 substantially parallels the axial direction of the shaft 2204.

The agitator 2205 has a capability to flip, by rotation, the projection 2202 provided to the vibration plate 2201 in addition to toner stirring capability. Each time the agitator 2205 makes one rotation, the agitator 2205 flips the projection 2202, and the vibration plate 2201 vibrates. In other words, the agitator 2205 serves as a contact member to contact the vibration plate 2201, and the vibration plate 2201 vibrates due to the contact with the agitator 2205. An aspect of the present embodiment is to detect the vibration of the vibration plate 2201, thereby detecting the amount of toner remaining inside the toner container 2200.

Figure 32A:
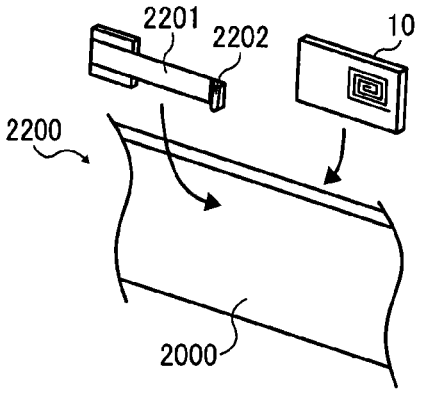
FIGS. 32A through 32D illustrate a manner of attachment of the magnetic flux sensor to the process cartridge according to the second embodiment.
Figure 32B:
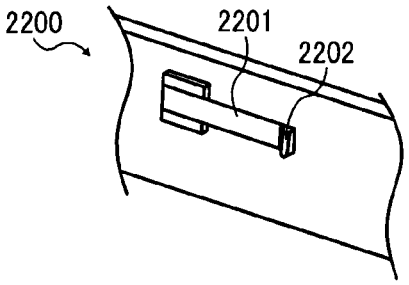
Figure 32C:
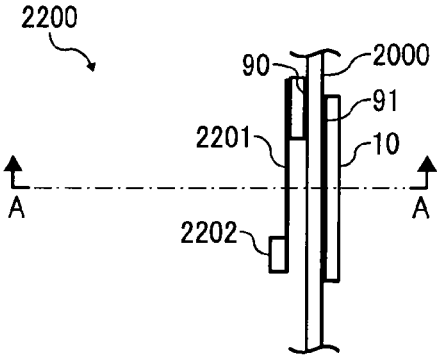
Figure 32D:
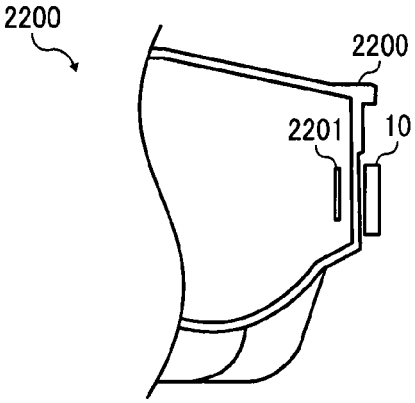

FIG. 32A is a perspective view of the toner container 2200 before the vibration plate 2201 and the magnetic flux sensor 10 are attached thereto. FIG. 32B is a perspective view of the toner container 2200 with the vibration plate 2201 and the magnetic flux sensor 10 attached thereto. FIG. 32C is a top view of the toner container 2200 with the vibration plate 2201 and the magnetic flux sensor 10 attached thereto. FIG. 32D is a cross-sectional view along line A-A in FIG. 32C.

In the manner of attachment illustrated in FIGS. 32A through 32D, the vibration plate 2201 and the magnetic flux sensor 10 are bonded to the toner container 2200 via the adhesive layers 90 and 91. Compared with attachment using fastenings such as screws, pins, and the like, this manner eliminates the necessity of through holes for the fastenings. Obviating the through holes is advantageous in that toner does not leak from the through holes, and thus toner is inhibited from scattering outside the toner container 2200. In other words, the space in which the vibration plate 2201 is disposed is isolated from the space in which the magnetic flux sensor 10 is disposed in the direction in which the vibration plate 2201 faces the magnetic flux sensor 10. Accordingly, leak of toner is inhibited.

Additionally, in the manner of attachment illustrated in FIGS. 32A through 32D, in which fastenings such as screws are not used, the number of components is smaller, thereby reducing the cost of the device, and the attachment is easier, thereby enhancing the productivity. Additionally, the manner of attachment illustrated in FIGS. 29A through 29D does not require seals to cover the through holes, thereby further reducing the cost and simplifying the assembling compared with a configuration that includes the through holes and the seals to cover the through holes.

In FIGS. 32A through 32D, the vibration plate 2201, a mount 2201*a* (i.e., a pedestal), and the projection 2202 are united together and then attached to the toner container 2200. In another embodiment, the mount 2201*a*, the vibration plate 2201, and the projection 2202 are sequentially attached to the toner container 2200 in that order. For example, the mount 2201*a* and the projection 2202 are attached to the vibration plate 2201 by welding, caulking, bonding, or the like.

Next, descriptions are given below of another manner of attachment of the vibration plate 2201 and the magnetic flux sensor 10 with reference to FIGS. 33A though 33D.

Figure 33A:
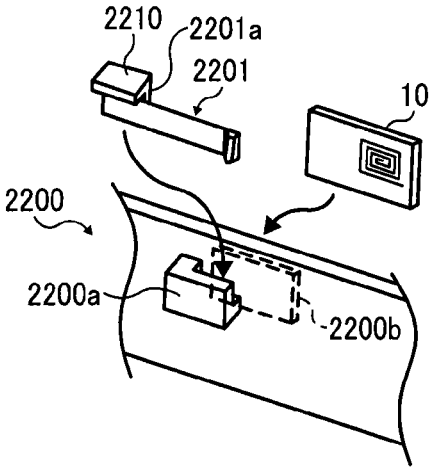
FIGS. 33A through 33D illustrate another manner of attachment of the magnetic flux sensor to the process cartridge according to the second embodiment.
Figure 33B:
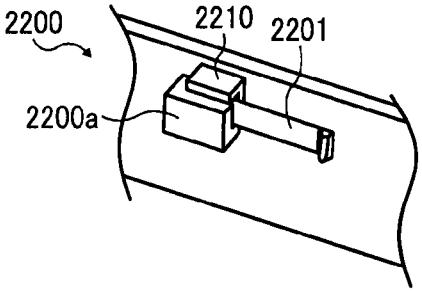
Figure 33C:
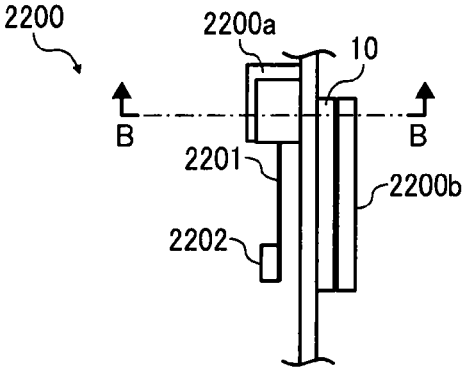
Figure 33D:
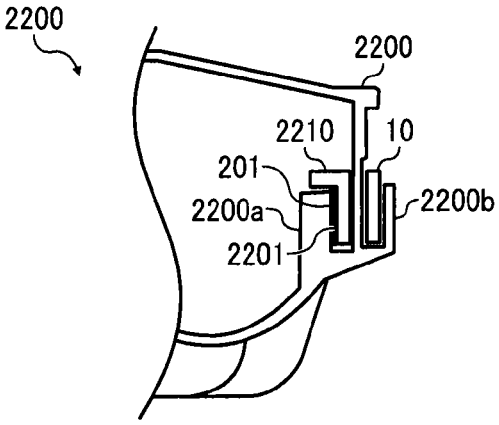

FIG. 33A is a perspective view of the toner container 2200 before the vibration plate 2201 and the magnetic flux sensor 10 are attached thereto. FIG. 33B is a perspective view of the toner container 2200 with the vibration plate 2201 and the magnetic flux sensor 10 attached thereto. FIG. 33C is a top view of the toner container 2200 with the vibration plate 2201 and the magnetic flux sensor 10 attached thereto. FIG. 33D is a cross-sectional view along line B-B in FIG. 33C.

The manner illustrated in FIGS. 33A through 33D involves fitting in ribs (i.e., recesses). Specifically, as illustrated in FIG. 33A, a rib 2200*a* is disposed on the inner face of the housing 2000 of the toner container 2200, and a rib 2200*b* is disposed on the outer face of the housing 2000.

As illustrated in FIG. 33A, the vibration plate 2201 is fitted in the rib 2200*a* to be secured inside the toner container 2200. As illustrated in FIG. 33D, the magnetic flux sensor is fitted in the rib 2200*b* to be secured to the outer wall of the toner container 2200.

The manner illustrated in FIGS. 33A through 33D inhibits scattering of toner, similarly, since the housing 2000 of the toner container 2200 does not include the through holes for the attachment. Similarly, since screwing or the like is not involved, assembling is easier. Additionally, since the fastenings and the seals to cover the through holes are obviated, the number of components is smaller, and the cost is reduced.

As illustrated in FIGS. 33A and 33D, the mount 2201*a* to hold the vibration plate 2201 includes a flat portion 2210, which is shaped like a hook bent from an upper end of the mount 2201*a*. In other words, in a state in which the vibration plate 2201 is fitted in the rib 2200*a*, the flat portion 2210 provides a face substantially vertical to the direction in which the vibration plate 2201 is fitted into the rib 2200*a*.

The flat portion 2210 serves as a pressed portion to be pressed by a worker while the worker fits the vibration plate 2201 into the rib 2200*a*. Thus, the attachment of the vibration plate 2201 is facilitated.

In another embodiment, the magnetic flux sensor 10 includes a portion equivalent to the flat portion 2210 of the vibration plate 2201. Such a configuration makes it easier to fit the magnetic flux sensor 10 into the rib 2200*b*. In the manner illustrated in FIGS. 33A through 33D, the adhesive layer is eliminated, thereby reducing the cost and facilitating the assembling work.

Additionally, the manner using the adhesive layers illustrated in FIGS. 32A through 32D can be combined with the manner using fitting illustrated in FIGS. 33A through 33D. For example, while the vibration plate 2201 is bonded to the toner container 2200, the magnetic flux sensor 10 is fitted in the recess in the toner container 2200. Alternatively, while the vibration plate 2201 is fitted in the recess, the magnetic flux sensor 10 is bonded to the toner container 2200.

Additionally, in the manner illustrated in FIGS. 32A through 32D and the manner illustrated in FIGS. 33A through 33D, the mount 2201*a* is attached to the vibration plate 2201 to secure the clearance between the inner face of the toner container 2200 and the vibration plate 2201. However, this is just an example. Alternatively, for example, the inner face of the toner container 2200 includes a mount equivalent to the mount 2201*a* to hold the vibration plate 2201.

The present embodiment employs the magnetic flux sensor 10 according to the first embodiment. Accordingly, descriptions of the structure and the function of the magnetic flux sensor 10 common to the first and second embodiments are omitted here.

In the toner container 2200 according to the present embodiment, similar to the sub-hopper 200 according to the first embodiment, the CPU 21 detects the vibration of the vibration plate 2201 based on the oscillation frequency of the magnetic flux sensor 10, using the characteristics illustrated in FIG. 11. The amount of toner remaining in the toner container 2200 is detected based on the vibration of the vibration plate 2201 thus detected, which is an aspect of the present embodiment. In other words, the vibration plate 2201 and the magnetic flux sensor 10 illustrated in FIGS. 32A through 33D as well as the structure to process the signal output from the magnetic flux sensor 10 is used as a powder detector according to the present embodiment. The powder detector is used as a developer amount detector to detect the amount of developer (e.g., toner) remaining in a container. Additionally, the magnetic flux sensor 10 serves as a signal oscillator.

The vibration of the vibration plate 2201 flipped by the agitator 2205 is expressed by an eigenfrequency defined by rigidity of the vibration plate 2201 and weight of the projection 2202, and an attenuation ratio defined by external factors to absorb the vibration energy. The external factors to absorb the vibration energy include, the presence of toner that contacts the vibration plate 2201 in the toner container 2200, in addition to fixed factors such as the holding strength of the mount 2201*a* cantilevering the vibration plate 2201 and air resistance.

The amount or state of toner that contacts the vibration plate 2201 changes depending on the amount of toner remaining in the toner container 2200. Accordingly, by detecting the vibration of the vibration plate 2201, the amount of toner remaining in the toner container 2200 is detected. In the toner container 2200 according to the present embodiment, the agitator 2205 to stir toner flips the vibration plate 2201 and vibrates the vibration plate 2201 periodically according to the rotation cycle.

Figure 34:
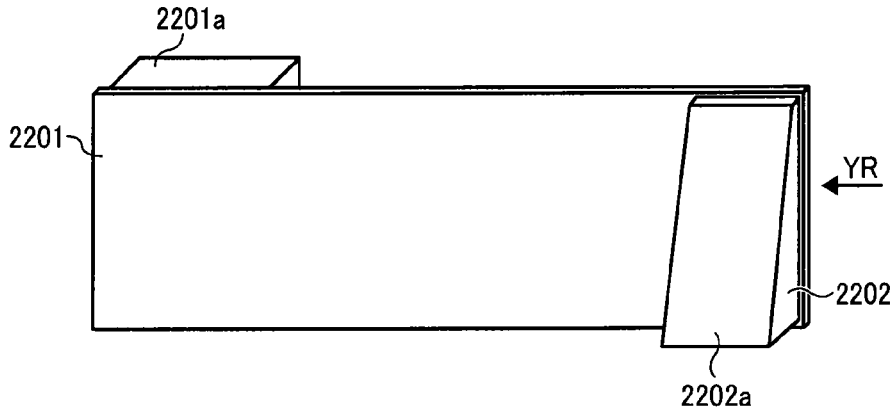
FIG. 34 is a perspective view of the variation plate according to the second embodiment.

Next, descriptions are given below of placement of components around the vibration plate 2201 in the toner container 2200 and the structure for the agitator 2205 to flip the vibration plate 2201. FIG. 34 is a perspective view illustrating a component layout around the vibration plate 2201. As illustrated in FIG. 34, the vibration plate 2201 is secured via the mount 2201*a* to the housing 2000 of the toner container 2200.

Figure 35:
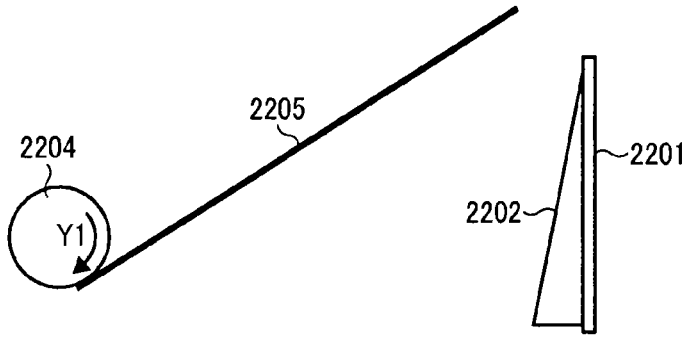
FIG. 35 is a side view illustrating the relative positions of the vibration plate and the agitator according to the second embodiment.

FIG. 35 is a side view illustrating a rotation position of the shaft 2204, at which the agitator 2205 is about to contact the projection 2202. The shaft 2204 rotates so that the agitator 2205 rotates clockwise in FIG. 35.

Figure 36:
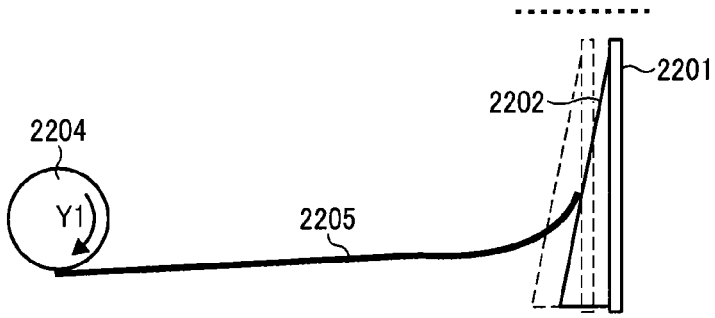
FIG. 36 is another side view illustrating the relative positions of the vibration plate and the agitator in the configuration illustrated in FIGS. 33 and 34.

As illustrated in FIGS. 34 and 35, the projection 2202 projects from a plate face (on the front side of paper on which FIG. 34 is drawn) of the vibration plate 2201 and inclined relative to the plate face of the vibration plate 2201 when viewed in the direction indicated by arrow YR. Specifically, the projection 2202 has an inclined face 2202*a* that approaches the shaft 2204 along the direction of rotation of the agitator 2205. The inclined face 2202*a* of the projection 2202 is pushed by the agitator 2205 when the agitator 2205 flips the vibration plate 2201. FIG. 36 is a side view of the agitator 2205, in which the agitator 2205 is positioned downstream in the direction indicated by arrow Y1 from the position illustrated in FIG. 35.

As the agitator 2205 rotates further while keeping in contact with the projection 2202, the vibration plate 2201 is pushed and deformed along the inclined face 2202*a*. In FIG. 36, broken lines represent positions of the vibration plate 2201 and the projection 2202 in a state in which no external force is applied thereto (stationary state). As illustrated in FIG. 36, the vibration plate 2201 and the projection 2202 are pushed in by the agitator 2205.

Figure 37:
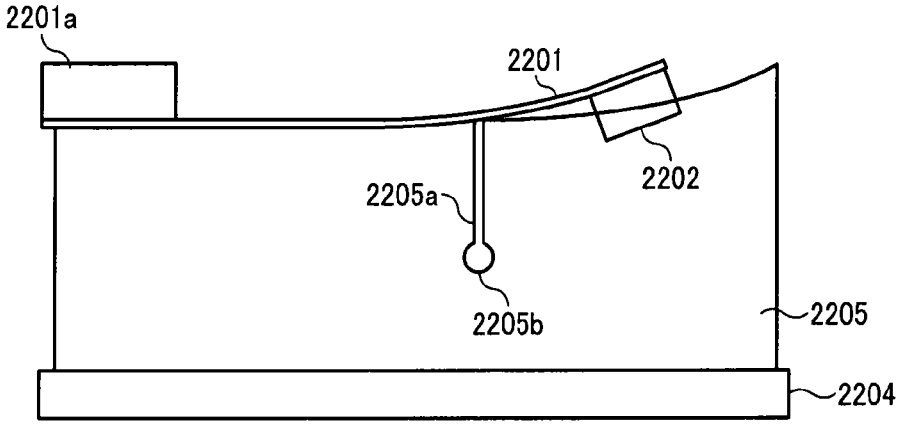
FIG. 37 is a top view of the vibration plate and the agitator in the state illustrated in FIG. 36.

FIG. 37 is a top view of the vibration plate 2201 in the state illustrated in FIG. 36. Since the vibration plate 2201 is secured via the mount 2201*a* to the inner face of the toner container 2200, the position of the first end of the vibration plate 2201 on the side of the mount 2201*a* does not change. By contrast, the opposite end of the vibration plate 2201, in which the projection 2202 is disposed, is pushed by the agitator 2205 and moves to the side opposite to the shaft 2204. Consequently, the vibration plate 2201 deforms, starting from the mount 2201*a*, as illustrated in FIG. 37. Energy to vibrate the vibration plate 2201 is accumulated in the vibration plate 2201 being in the deformed state.

It is to be noted that, in the configuration illustrated in FIG. 37, the agitator 2205 includes a slit 2205*a* positioned between a portion to contact the projection 2202 and the rest of the agitator 2205. With this configuration, even if the agitator 2205 receives strong force while pushing the projection 2202, damage to the agitator 2205 is inhibited.

The slit 2205*a* includes a round end 2205*b* at a start point of slit. When the amount of deformation differs between the portions adjoining via the slit 2205*a*, the round end 2205*b* disperses the stress given to the start point of the slit 2205*a*, thereby inhibiting damage to the agitator 2205.

Figure 38:
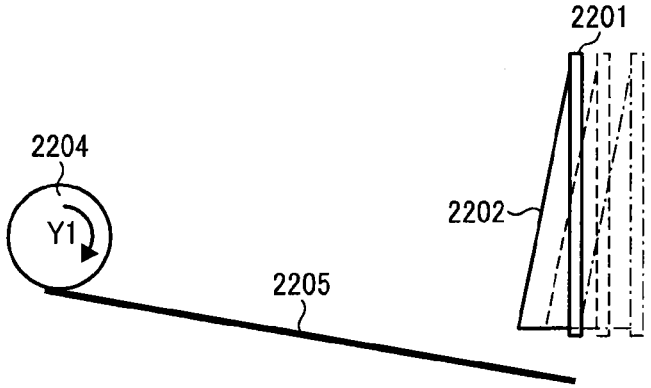
FIG. 38 is another side view illustrating the relative positions of the vibration plate and the agitator according to the second embodiment.

FIG. 38 is a side view of the agitator 2205 being positioned downstream in the direction indicated by arrow Y1 from the position illustrated in FIG. 36. In FIG. 38, broken lines represents the position of the vibration plate 2201 being in the stationary state, and alternate long and short dashed lines represent the position of the vibration plate 2201 illustrated in FIG. 36. When the vibration energy, which has been accumulated by the agitator 2205 pushing the vibration plate 2201, is released, the vibration plate 2201 deforms to the opposite side as represented by solid lines.

Figure 39:
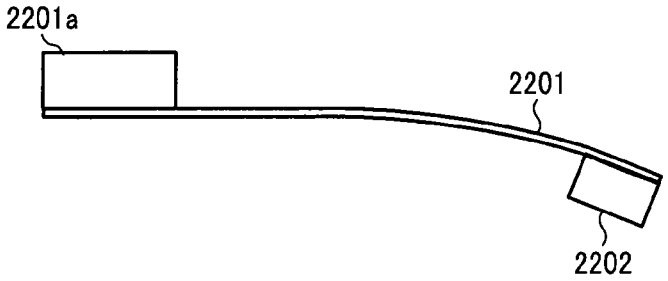
FIG. 39 is a top view illustrating vibration of the vibration plate according to the second embodiment.

FIG. 39 is a top view of the vibration plate 2201 in the state illustrated in FIG. 38. As illustrated in FIG. 38, when the pushing force given to the projection 2202 by the agitator 2205 is released, owing to the energy of deformation accumulated in the vibration plate 2201, the free end of the vibration plate 2201, provided with the projection 2202, deforms and moves to the opposite side.

In the state illustrated in FIGS. 38 and 39, the vibration plate 2201 is away from the magnetic flux sensor 10, which faces the vibration plate 2201 via the housing 2000 of the toner container 2200. Subsequently, while the vibration plate 2201 repeatedly approaches, by vibration, the magnetic flux sensor 10 further from the stationary state and moves, by vibration, away therefrom further from the stationary state, the vibration plate 2201 returns to the stationary state as the vibration attenuates.

Figure 40:
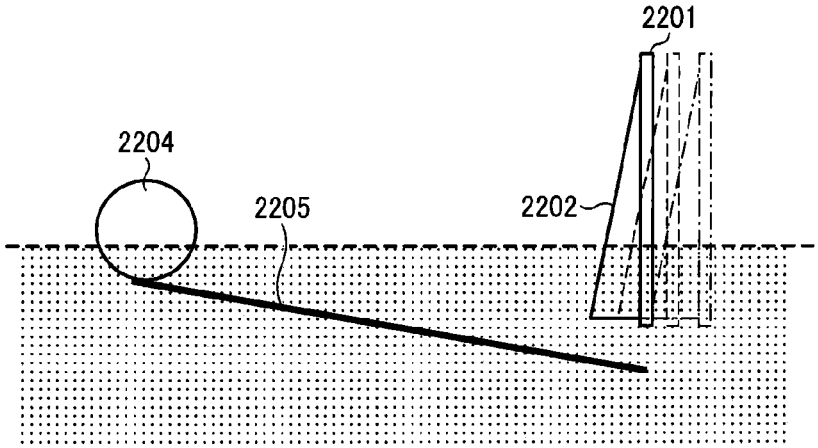
FIG. 40 is a side view illustrating the relation between the vibration of the vibration plate and developer, according to the second embodiment.

FIG. 40 schematically illustrates a state of toner (represented by dots) stored in the toner container 2200. When toner is present in the toner container 2200 as illustrated in FIG. 40, the vibration plate 2201 and the projection 2202 contact the toner while vibrating. Accordingly, compared with a state in which toner is not present in the toner container 2200, the vibration of the vibration plate 2201 attenuates early. According to changes in attenuation of vibration, the amount of remaining toner in the toner container 2200 is detected.

It is to be noted that the CPU 21 of the controller 20 analyzes the manner of attenuation of the vibration of the vibration plate 2201 based on the oscillation signal output from the developer amount detector including the magnetic flux sensor 10 and the vibration plate 2201. Thus, the CPU 21 detects the amount of toner remaining in the toner container 2200. The processes and manners of the detection are similar to those of the first embodiment described above with reference to FIGS. 19 through 22.

Similar to the first embodiment, variations, such as those described with reference to FIGS. 23 through 27, can adapt to the second embodiment.

Additionally, the process cartridge 2106 described in the second embodiment is a so-called all-in-one process cartridge and does not has a capability to supply toner to the toner container 2200. However, this is just an example, and the above-described aspects can adapt to process cartridges to which toner cartridges are removably attachable to supply toner to the process cartridges. Such a process cartridge is described below with reference to FIG. 41.

Figure 41:
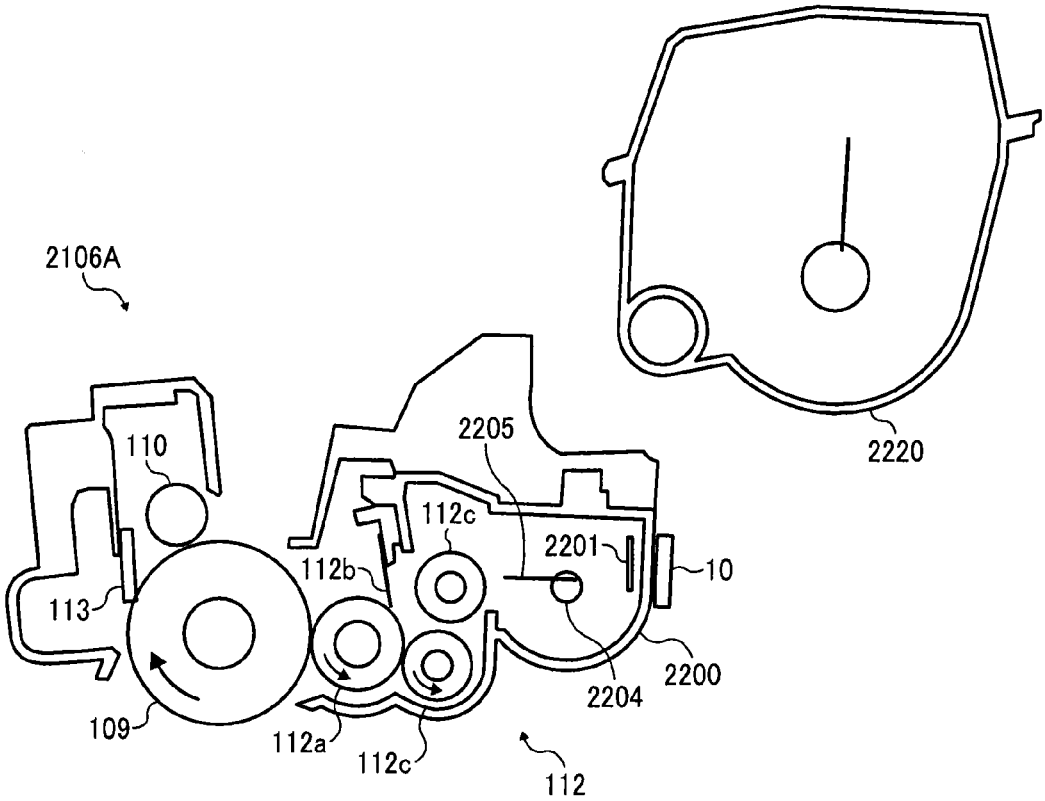
FIG. 41 is a schematic cross-sectional view of another process cartridge according to the second embodiment.

FIG. 41 is a cross-sectional view of a process cartridge 2106A to which a toner cartridge 2220 is attachable for toner supply.

The process cartridge 2106A illustrated in FIG. 41 is similar in structure to the all-in-one process cartridge 2106 illustrated in FIG. 31 except that the toner cartridge 2220 is removably attached to the toner container 2200 to supply toner to the toner container 2200.

Similar to the structure illustrated in FIG. 31, in the process cartridge 2106A illustrated in FIG. 41, the toner container 2200 includes the magnetic flux sensor 10 and the vibration plate 2201 to detect the amount of toner in the toner container 2200. Compared with the toner cartridge 2220, the frequency of replacement of the process cartridge 2106A is lower. Accordingly, disposing the magnetic flux sensor 10 and the vibration plate 2201 in the toner container 2200 not the toner cartridge 2220 is advantageous in reducing the frequency of replacement of the magnetic flux sensor 10 and the vibration plate 2201, thereby reducing the cost.

Third Embodiment

In the second embodiment, the magnetic flux sensor 10 is attached to the process cartridge 2106. By contrast, in a third embodiment, the magnetic flux sensor 10 is attached to the body of the image forming apparatus 100. It is to be noted that elements similar to those of the first and second embodiments are given identical or similar reference characters, and thus descriptions thereof omitted.

Figure 42:
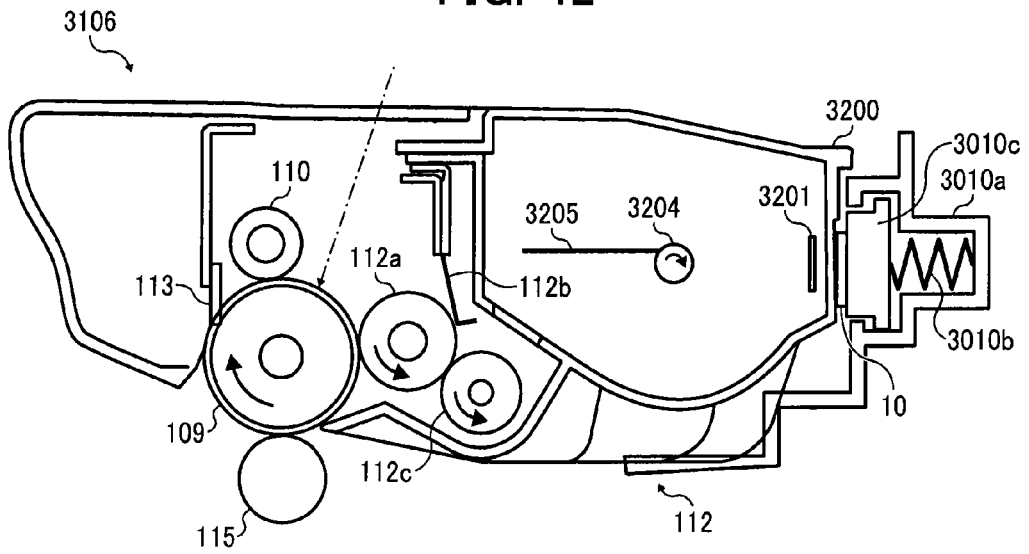
FIG. 42 is a schematic cross-sectional view of a process cartridge and an adjacent configuration according to a third embodiment.

FIG. 42 is a schematic cross-sectional view of a process cartridge 3106 (i.e., an image forming unit) and an adjacent configuration according to the third embodiment.

As illustrated in FIG. 42, the relative positions of a vibration plate 3201 and the magnetic flux sensor 10 in a toner container 3200 of the process cartridge 3106 are similar to those in the first and second embodiments. The present embodiment is different from the second embodiment in that the magnetic flux sensor 10 is attached to not the process cartridge 3106 but the body (hereinafter also "apparatus body") of the image forming apparatus 100.

Figure 43:
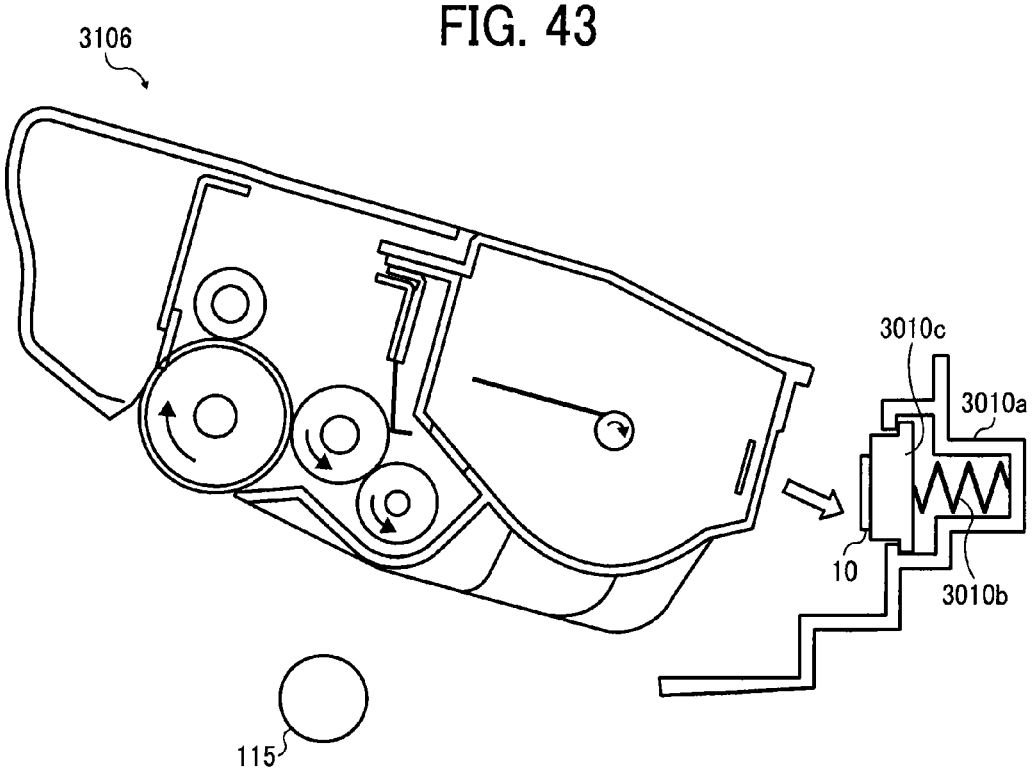
FIG. 43 is a schematic cross-sectional view of the process cartridge and the adjacent configuration according to the third embodiment.

FIG. 43 is a cross-sectional view of the process cartridge 3106 removed from the apparatus body. As illustrated in FIG. 43, a process cartridge mount of the image forming apparatus 100, in which the process cartridge 3106 is mounted, includes a sensor support 3010*a* disposed to face the toner container 3200 when the process cartridge 3106 is mounted in the apparatus body.

To the sensor support 3010*a*, a push part 3010*c* is connected via an elastic body 3010*b*. The magnetic flux sensor 10 is attached to the push part 3010*c*. The elastic body 3010*b* is made of an elastic material, such as rubber and spring, and projects beyond the sensor support 3010*a* with the elastic force exerted by the elastic body 3010*b* in a state in which the process cartridge 3106 is removed from the image forming apparatus 100.

As the process cartridge 3106 is mounted in the apparatus body as illustrated in FIG. 42, due to the elastic force exerted by the elastic body 3010*b*, the magnetic flux sensor 10 attached to the push part 3010*c* is pressed to the process cartridge 3106. With this action, similar to the above-described second embodiment, the magnetic flux sensor 10 can detect the vibration of the vibration plate 3201.

Figure 44:
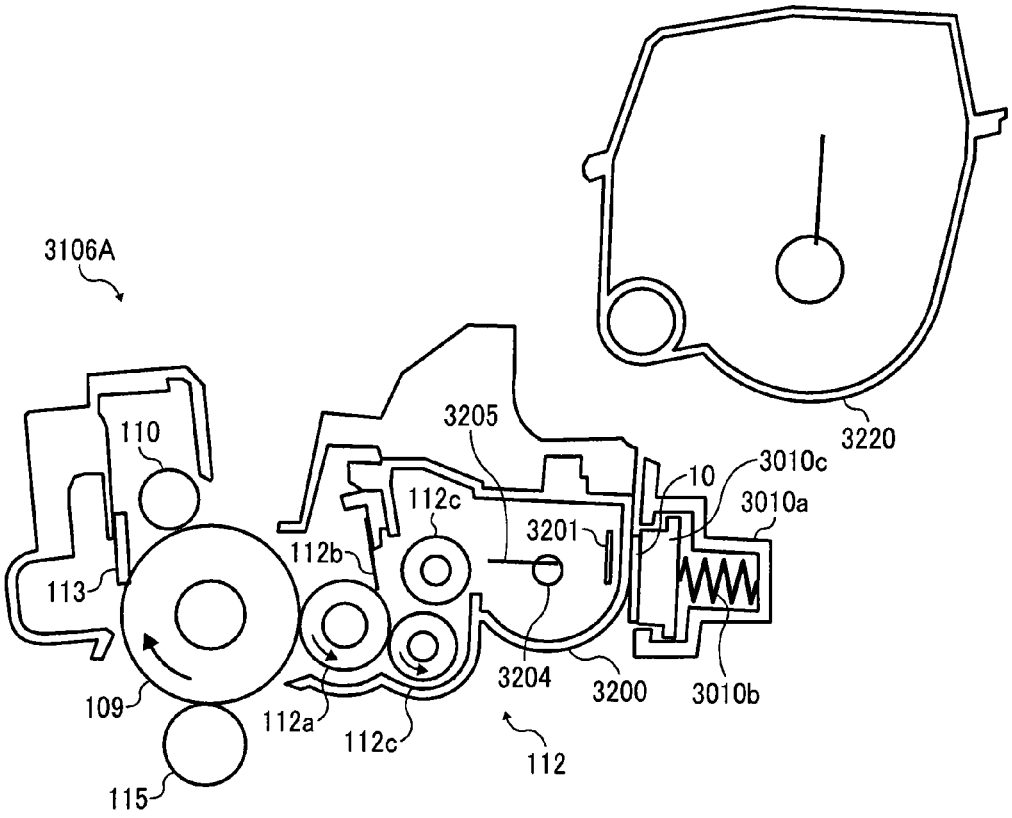
FIG. 44 is a schematic cross-sectional view of the process cartridge and the adjacent configuration according to the third embodiment.

FIG. 44 is a cross-sectional view of a process cartridge 3106A to which a toner cartridge 3220 is attachable for toner supply. Similar to the structure illustrated in FIG. 42, in the structure illustrated in FIG. 44, the image forming apparatus 100 includes the sensor support 3010*a* positioned to face the toner container 3200 when the process cartridge 3106A is mounted in the image forming apparatus 100.

Figure 45:
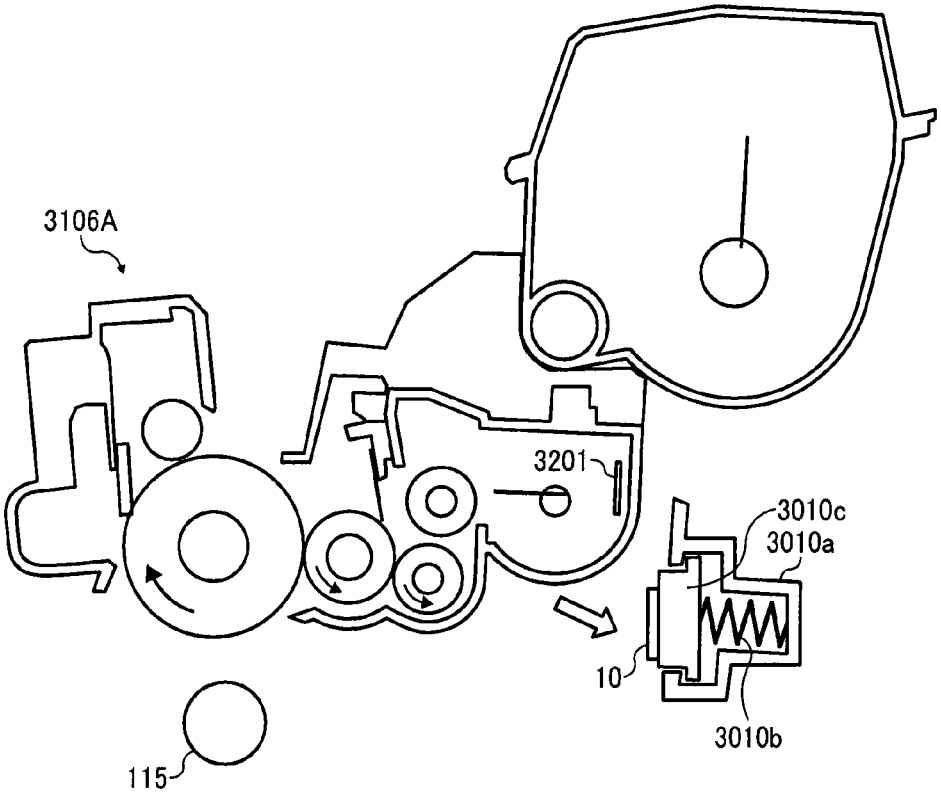
FIG. 45 is a schematic cross-sectional view of the process cartridge and the adjacent configuration according to the third embodiment.

In FIG. 45, the process cartridge 3106A, with the toner cartridge 3220 attached thereto, is removed from the apparatus body. As illustrated in FIG. 45, the sensor support 3010*a* projects beyond the sensor support 3010*a* with the elastic force exerted by the elastic body 3010*b* in the state in which the process cartridge 3106A is separate from the image forming apparatus 100.

As the process cartridge 3106 is mounted in the image forming apparatus 100 as illustrated in FIG. 44, due to the elastic force exerted by the elastic body 3010*b*, the push part 3010*c* presses the magnetic flux sensor 10 attached to the push part 3010*c* to the process cartridge 3106A. Then, the magnetic flux sensor 10 is positioned to face the vibration plate 3201. With this action, similar to the above-described second embodiment, the magnetic flux sensor 10 can detect the vibration of the vibration plate 3201.

It is to be noted that, being mounted in the apparatus body, the process cartridge 3106 (or 3106A) is secured at a predetermined position relative to the apparatus body. Accordingly, the position of the magnetic flux sensor 10, which is held by the sensor support 3010*a* and the push part 3010*c*, is determined in accordance with the positioning of the process cartridge 3106, and thus the vibration plate 3201 of the process cartridge 3106 and the magnetic flux sensor 10 are set in position relative to each other. With this configuration, detection error caused by misalignment of the vibration plate 3201 and the magnetic flux sensor 10 can be avoided.

Figure 46:
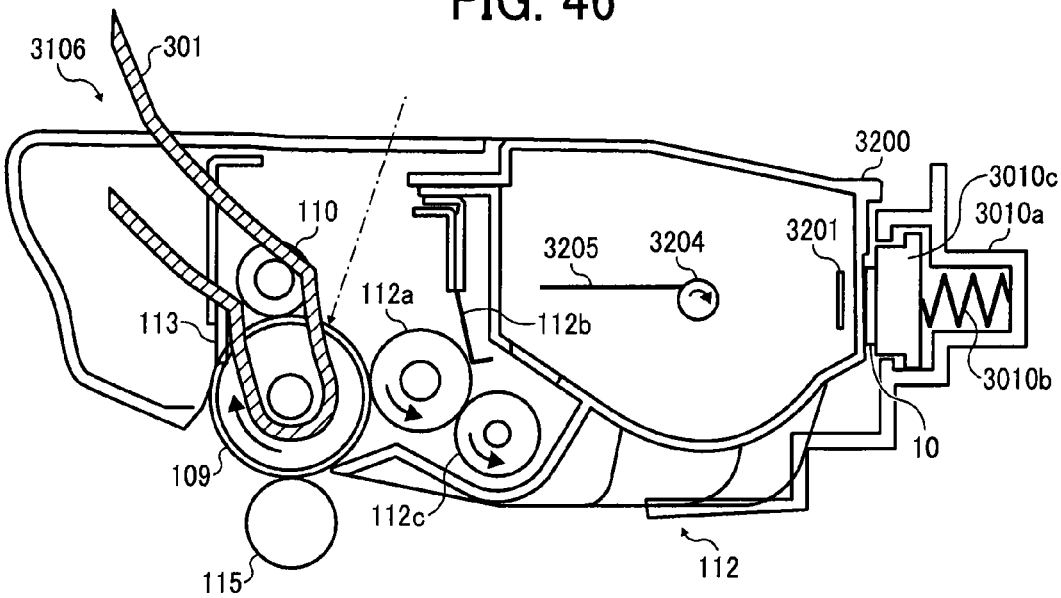
FIG. 46 is a cross-sectional view illustrating positioning of the process cartridge common to the second and third embodiments.

Referring to FIG. 46, descriptions are given below of positioning of the process cartridge 3106 in the apparatus body. This positioning is adaptable to the process cartridges 2106, 2106A, and 3106A.

The process cartridge mount of the apparatus body includes a guide rail 301 serving as a positioning member on body side. In FIG. 46, the guide rail 301 is hatched for ease of understanding.

In the process cartridge 3106, a rotation shaft of the photoconductor drum 109 and an adjacent structure projects to both ends in the axial direction of the photoconductor drum 109, and the projecting portions are used as positioning members on process cartridge side. Specifically, referring to FIG. 46, the guide rail 301 is provided on either end side in the axial direction of the photoconductor drum 109. As the projecting portions move along the guide rails 301, the process cartridge 3106 is set in the apparatus body. When the projecting portion reaches an end of the guide rail 301, the process cartridge 3106 is positioned in the apparatus body, and mounting the process cartridge 3106 therein is completed. At that time, an end of the process cartridge 3106 in the direction in which the process cartridge 3106 is mounted is in contact with the magnetic flux sensor 10.

In this manner of positioning, the positioning accuracy of the vibration plate 2201 (or 3201) of the process cartridge 2106 (or 3106) and the magnetic flux sensor 10 can be enhanced by enhancing the positioning accuracy of the guide rail 301 and the magnetic flux sensor 10 in the apparatus body.

Figure 47:
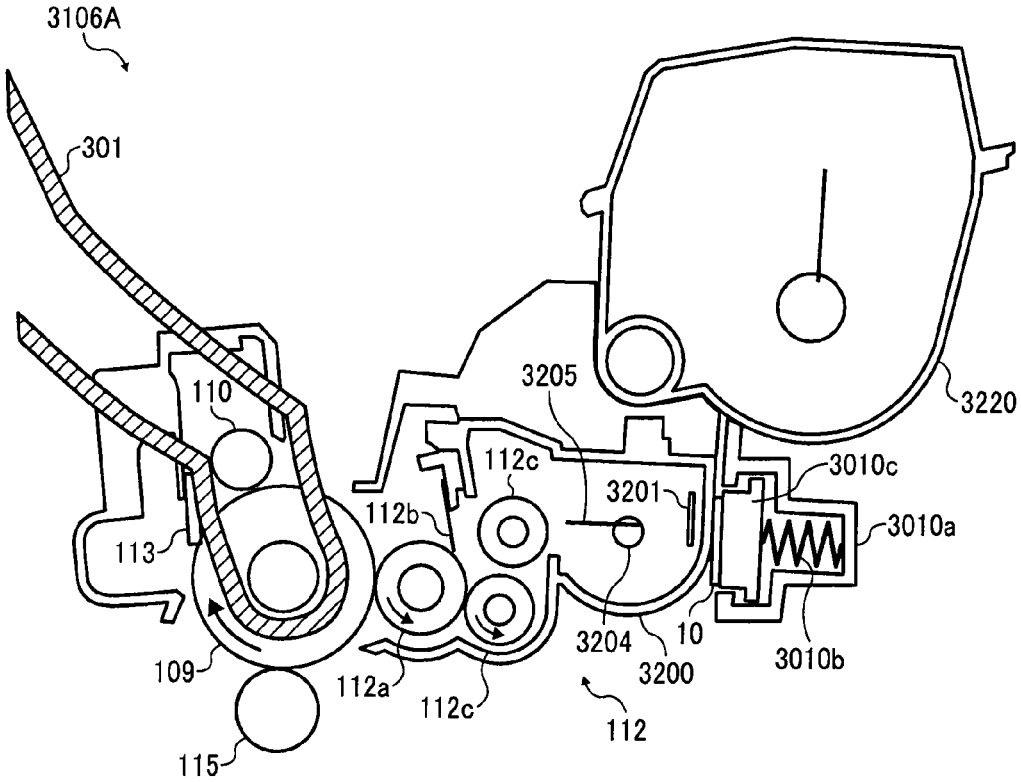
FIG. 47 is a cross-sectional view illustrating positioning of the process cartridge common to the second and third embodiments.

FIG. 47 is for understanding of positioning of the process cartridge 3106A (illustrated in FIGS. 44 and 45) to which the toner cartridge 3220 is attachable for toner supply. Similar to the positioning described with reference to FIG. 46, as the projecting portions move along the guide rails 301 of the apparatus body, the process cartridge 3106A is set in the apparatus body.

It is to be noted that the steps in the above-described methods may be executed in an order different from the description above.

Numerous additional modifications and variations are possible in light of the above teachings. It is therefore to be understood that, within the scope of the appended claims, the disclosure of this patent specification may be practiced otherwise than as specifically described herein.

What is claimed is:

1. A powder detector to detect an amount of powder in a powder container, the powder having flowability, the powder detector comprising:

a wall without a through hole;

a vibration plate attached to an inner face of the wall;

a contact member to vibrate the vibration plate; and a vibration detector to detect a vibration state of the vibration plate affected by the powder in the powder container, the vibration detector attached to an outer face of the wall and disposed to face the vibration plate via the wall.

2. The powder detector according to claim 1, wherein the inner face of the wall comprises a recess in which the vibration plate is fitted.

3. The powder detector according to claim 2, wherein the vibration plate comprises a face substantially perpendicular to a direction in which the vibration plate is fitted in the recess.

4. The powder detector according to claim 1, wherein the outer face of the wall comprises a recess in which the vibration detector is fitted.

5. The powder detector according to claim 4, wherein the vibration detector comprises a face substantially perpendicular to a direction in which the vibration detector is fitted in the recess.

6. The powder detector according to claim 1, further comprising an adhesive layer disposed between a face of the wall and at least one of the vibration plate and the vibration detector.

7. The powder detector according to claim 1, further comprising:

a first adhesive layer disposed between the inner face of the wall and the vibration plate; and a second adhesive layer disposed between the outer face of the wall and the vibration detector.

8. The powder detector according to claim 1, further comprising a shaft to rotate inside the powder container, wherein the contact member is attached to the shaft to rotate together with the shaft, a first end of the vibration plate in an axial direction of the shaft is secured, and the vibration plate includes a projection projecting toward the shaft from a second end opposite the first end, the projection pressed by the contact member.

9. The powder detector according to claim 1, further comprising:

a frequency-related data output to output frequency-related data; and a detection result processor to acquire, in each predetermined sampling cycle, the frequency-related data from the frequency-related data output, wherein the vibration detector includes a signal oscillator to output an oscillation signal having a frequency corresponding to a state of a magnetic flux passing through a space opposed to the vibration detector, the frequency-related data relates to the frequency of the oscillation signal of the signal oscillator and changes corresponding to the vibration state of the vibration plate, the vibration plate is made of a material to affect the magnetic flux and disposed facing the signal oscillator via a wall of the powder container to vibrate in a direction in which the vibration plate faces the signal oscillator, and the detection result processor detects the vibration state of the vibration plate based on a change in the frequency-related data and determines the amount of the powder in the powder container.

10. An image forming apparatus comprising:

an image forming unit to form an image;

the powder container to contain a powder used by the image forming unit to form the image; and the powder detector according to claim 1 to detect an amount of the powder in the powder container.

11. The image forming apparatus according to claim 10, wherein the image forming unit comprises a developing device to develop a latent image with the powder, the powder container is disposed between the developing device and a toner container to be removably mounted in the image forming apparatus, and the powder container is to temporality store toner supplied from the toner container.

12. A developing device to be mounted in an image forming apparatus removably, the image forming apparatus including:

a frequency-related data output to output frequency-related data;

a signal oscillator to output an oscillation signal corresponding to a state of a magnetic flux passing through a space opposed to the signal oscillator; and a detection result processor to acquire, in each predetermined sampling cycle, the frequency-related data from the frequency-related data output, the developing device comprising:

a developer container to contain developer;

a vibration plate made of a material to affect the magnetic flux, the vibration plate disposed in the developer container to face the signal oscillator via a wall of the developer container and to vibrate in a direction in which the vibration plate faces the signal oscillator when the developing device is mounted in the image forming apparatus; and a contact member to vibrate the vibration plate;

wherein the frequency-related data relates to a frequency of the oscillation signal and changes corresponding to a vibration state of the vibration plate, and the detection result processor detects the vibration state of the vibration plate based on a change in the frequency-related data and determines an amount of the developer in the developer container based on the vibration state detected.

13. A process cartridge to be removably mounted in an image forming apparatus, the process cartridge comprising:

an image bearer to bear a latent image;

a charging device to charge a surface of the image bearer;

a cleaning device to clean the surface of the image bearer; and the developing device according to claim 12 to develop the latent image on the image bearer.

14. An image forming apparatus comprising the process cartridge according to claim 13.

15. A powder detecting method to detect an amount of powder in a powder container, the powder having flowability, the powder detecting method comprising:

vibrating, by a contact member, a vibration plate attached to an inner face of a wall of the powder container without a through hole;

detecting, with a vibration detector, a vibration state of the vibration plate affected by the powder in the powder container, the vibration detector attached to an outer face of the wall and disposed to face the vibration plate via the wall; and determining the amount of the powder in the powder container according to the vibration state detected.

16. The powder detecting method according to claim 15, wherein the vibration detector comprises a signal oscillator to output an oscillation signal having a frequency corresponding to a state of a magnetic flux passing through a space opposed to the vibration detector, the vibration plate is disposed facing the signal oscillator via a wall of the powder container and to vibrate in a direction in which the vibration plate faces the signal oscillator, the vibration plate is made of a material to affect the magnetic flux, the powder detecting method further comprises:

outputting, from the signal oscillator, the oscillation signal having the frequency corresponding to the state of the magnetic flux passing through the space opposed;

acquiring, in each predetermined sampling cycle, frequency-related data that relates to the frequency of the oscillation signal and changes corresponding to the vibration state of the vibration plate;

detecting the vibration state of the vibration plate based on a change in the frequency-related data, and determining the amount of the powder in the powder container according to the vibration state detected.

* * * * *